US007731538B2

(12) United States Patent
Kiryu et al.

(10) Patent No.: US 7,731,538 B2
(45) Date of Patent: Jun. 8, 2010

(54) CARD CONNECTOR

(75) Inventors: Koichi Kiryu, Shimotakai-gun (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/878,400

(22) Filed: Jul. 24, 2007

(65) Prior Publication Data

US 2008/0207060 A1 Aug. 28, 2008

(30) Foreign Application Priority Data

Feb. 28, 2007 (JP) ..... 2007-050480

(51) Int. Cl.
*H01R 24/00* (2006.01)

(52) U.S. Cl. ..... 439/630; 439/138

(58) Field of Classification Search ..... 439/630, 439/924.1, 631, 159, 135, 138
See application file for complete search history.

(56) References Cited

U.S. PATENT DOCUMENTS

| | | | | |
|---|---|---|---|---|
| 6,386,920 | B1 * | 5/2002 | Sun | 439/630 |
| 6,402,529 | B2 * | 6/2002 | Saito et al. | 439/74 |
| 6,699,053 | B2 * | 3/2004 | Kuroda | 439/218 |
| 6,716,066 | B1 * | 4/2004 | Kuo | 439/630 |
| 6,908,321 | B1 * | 6/2005 | Lai | 439/140 |
| 7,011,549 | B1 * | 3/2006 | Lai | 439/630 |
| 7,044,797 | B1 * | 5/2006 | Lai | 439/630 |
| 7,052,325 | B2 * | 5/2006 | Lin et al. | 439/630 |
| 7,241,177 | B1 * | 7/2007 | Lai | 439/635 |
| 7,364,466 | B2 * | 4/2008 | Yen | 439/630 |
| 7,371,089 | B2 * | 5/2008 | Cheng | 439/159 |
| 7,431,595 | B1 * | 10/2008 | Yen et al. | 439/138 |

FOREIGN PATENT DOCUMENTS

| | | |
|---|---|---|
| JP | 2002-024771 | 1/2002 |
| JP | 2005-209550 | 8/2005 |
| JP | 2006-196302 | 7/2006 |

* cited by examiner

*Primary Examiner*—Xuong M Chung-Trans
(74) *Attorney, Agent, or Firm*—Staas & Halsey LLP

(57) ABSTRACT

A card connector is disclosed that includes a housing for accommodating a first card, a second card, and a third card; a first contact member arranged to be connected to the first card; a second contact member arranged to be connected to the second card, which has a larger width than the first card and a smaller thickness than the first card; a third contact member arranged to be connected to the third card, which has a smaller width than the first and second card and a smaller thickness than the first and second card; and a connection control mechanism that selectively connects one of the first card, the second card, or the third card. When one of the first card, the second card, or the third card is connected, the connection control mechanism prevents the other cards from being connected.

15 Claims, 29 Drawing Sheets

FIG.1C
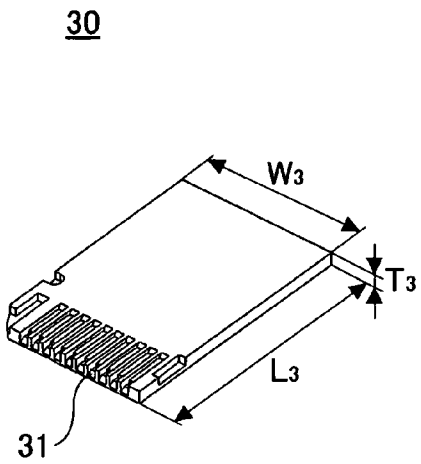
FIG.1B
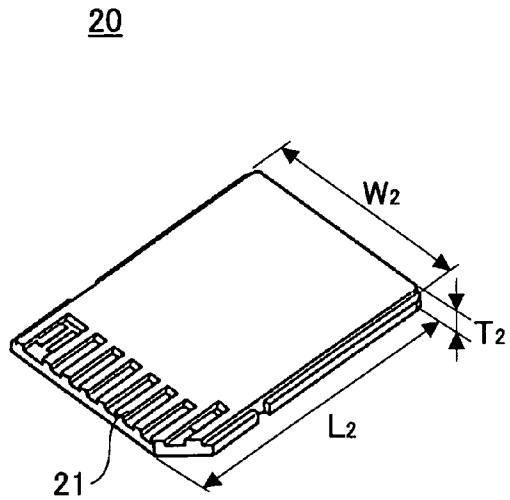
FIG.1A
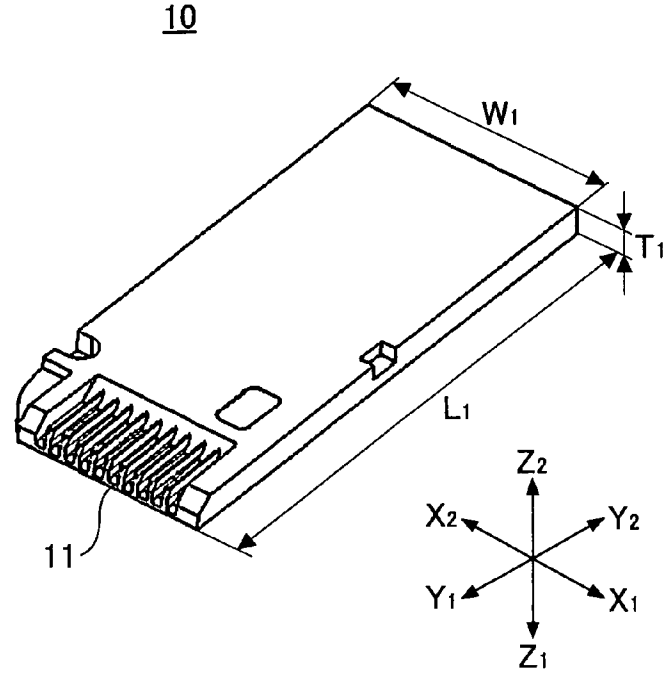
FIG.1D
| | WIDTH (mm) | LENGTH (mm) | THICKNESS (mm) |
|---|---|---|---|
| FIRST MEMORY CARD (MEMORY STICK) 10 | $W_1$=21.5 | $L_1$=50 | $T_1$=2.8 |
| SECOND MEMORY CARD (SD CARD) 20 | $W_2$=24 | $L_2$=32 | $T_2$=2.1 |
| THIRD MEMORY CARD (MEMORY STICK Duo) 30 | $W_3$=20 | $L_3$=31 | $T_3$=1.6 |
$L_1 > L_2 > L_3$ $W_2 > W_1 > W_3$ $T_1 > T_2 > T_3$ 10
100
130
150
62
60
51
110
52
$Z_1$
$Y_1$
$X_1$
$Z_2$
$X_2$
$Y_2$ 62
150
100
130
60
51
21
22
20
23
110
$Z_1$
$Y_1$
$X_1$
$Z_2$
$X_2$
$Y_2$

CARD CONNECTOR

BACKGROUND OF THE INVENTION

1. Field of the Invention

The present invention relates to a card connector that is built into an electronic apparatus such as a digital camera and is capable of selectively connecting three different types of memory cards having differing widths and thicknesses.

2. Description of the Related Art

An electronic apparatus such as a digital camera, a portable audio player, a mobile phone, or an electronic copier has a memory card connector built therein, and such an electronic apparatus is used by connecting a memory card including a semiconductor memory element to the memory card connector.

Presently, a number of memory cards with differing outer dimensions (lengths, widths, and thicknesses) are known. In the case of configuring an electronic apparatus to be adaptable to plural types of memory cards, normally, a first memory card connector dedicated for a first type of memory card and a second memory card connector dedicated for a second type of memory card are arranged within the electronic apparatus. However, such a structure including plural memory card connectors in the electronic apparatus may not be desirable in view of the demand for miniaturization of the electronic apparatus.

In turn, memory card connectors have been developed that are capable of connecting two types of memory cards by enabling either one of a first type of memory card or a second type of memory card to be selectively loaded via one common memory card loading slot (e.g., see Japanese Laid-Open Patent Publication No. 2006-196302, No. 2005-209550, and No. 2002-24771).

It is noted that the above disclosures relate to card connectors adapted for connecting two types of memory cards; however, with the growing variety of memory cards being used, there is a demand for a memory card connector that is adapted for connecting three types of memory cards.

SUMMARY OF THE INVENTION

According to one embodiment of the present invention, a card connector is provided that includes:

a housing for accommodating a first card, a second card, and a third card;

a first contact member arranged inside the housing to be connected to the first card;

a second contact member arranged inside the housing to be connected to the second card, which has a larger width than the first card and a smaller thickness than the first card;

a third contact member arranged inside the housing to be connected to the third card, which has a smaller width than the first card and the second card and a smaller thickness than the first card and the second card; and a connection control mechanism arranged inside the housing that is configured to selectively connect one of the first card, the second card, or the third card;

wherein when one of the first card, the second card, or the third card is connected, the connection control mechanism prevents the other cards from being connected.

According to an aspect of the present invention, a first card, a second card, as well as a third card, which has a smaller width and a smaller thickness than the first and second card may be connected to a common card connector. According to another aspect of the present invention, when one of the first card, the second card, or the third card is connected to the card connector, the other cards are prevented from being connected in order to avoid a case of inadvertently connecting more than one card at the same time.

BRIEF DESCRIPTION OF THE DRAWINGS

FIGS. 1A-1C are diagrams showing first through third memory cards turned upside down;

FIG. 1D is a table indicating the lengths, widths, and thicknesses of the first through third cards;

DESCRIPTION OF THE PREFERRED EMBODIMENTS

Figure 2:
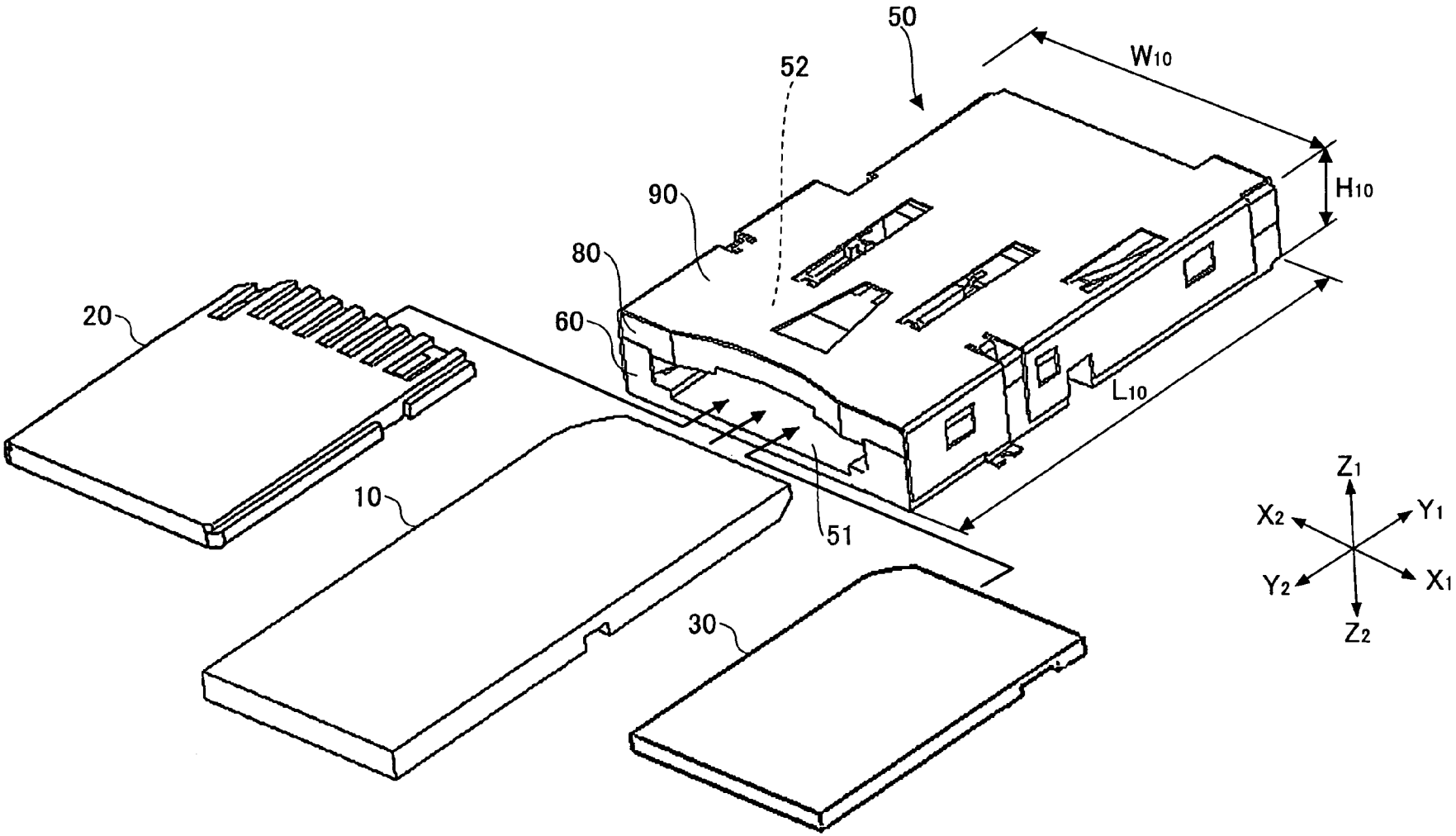
FIG. 2 is a diagram showing a card connector according to a first embodiment of the present invention in relation to the first through third cards.

In the following, preferred embodiments of the present invention are described with reference to the accompanying drawings. It is noted that in the drawings, directions X1-X2 represent width directions, directions Y1-Y2 represent length directions, and directions Z1-Z2 represent thickness (height) directions. Also direction Y1 represents the direction in which a memory card is to be inserted into a memory card connector, and direction Y2 represents the direction in which the memory card is to be ejected.

First Embodiment

In the following, first, second, and third memory cards that may be loaded into a memory card connector are described.

FIGS. 1A-1C are diagrams showing memory cards that are turned upside down. The illustrated memory cards of FIGS. 1A-1C have 1C memories arranged in their interior and contacts 11, 21, and 31 arranged along their insertion direction side edges.

FIG. 1A shows a first memory card (memory stick (trademark)) 10 with width W1 (21.5 mm), length L1 (50 mm), and thickness T1 (2.8 mm).

FIG. 1B shows a second memory card (SD card (trademark)) 20 with width W2 (24 mm), length L2 (32 mm) and thickness T2 (2.1 mm).

FIG. 1C shows a third memory card (memory stick Duo (trademark)) 30 with width W3 (20 mm), length L3 (31 mm), and thickness T3 (1.6 mm). It is noted that in the following descriptions, 'memory card' may simply be referred to as 'card'.

FIG. 1D is a table indicating the widths, lengths, and thicknesses of the first, second, and third cards 10, 20, and 30. As can be appreciated, the widths W1, W2, W3, the lengths L1, L2, L3, and the thicknesses T1, T2, T3 of the first, second, and third cards 10, 20, and 30 satisfy the following relationships:

$$L1>L2>L3$$

$$W2>W1>W3$$

$$T1>T2>T3$$

It is noted that vertical cross sections (W1×T1) and (W2×T2) of the first card 10 and the second card 20 are similar in size while the length L1 of the first card 10 is longer than the length L2 of the second card 20. The width W3 of the third card 30 is smaller than the widths W1 and W2, the thickness T3 of the third card 30 is smaller than the thicknesses T1 and T2, and the vertical cross section (W3×T3) is smaller than the vertical cross sections (W1×T1) and (W2×T2). Also, the length L3 of the third card 30 is shorter than the lengths L1 and L2.

[Overview of Memory Card Connector 50]

FIG. 2 is a diagram showing a memory card connector 50 according to a first embodiment of the present invention and the first, second, and third cards 10, 20, and 30. It is noted that in the following descriptions, 'memory card connector' may simply be referred to as 'card connector'.

As is shown in FIG. 2, the card connector 50 includes a lower housing 60, an upper housing 80, and a metal plate cover member 90, and is arranged into a flat rectangular cubic structure with length L10, width W10, and height H10. Also, the card connector 50 includes first, second, and third card contact members 61, 62, and 63 (see FIG. 3B), a push-push type card ejecting mechanism that uses a heart cam mechanism (not shown), a common card loading slot 51 through which the first, second, and third cards 10, 20, and 30 may be loaded, and a card accommodating space 52 for accommodating a card that is connected to the loading slot 51. It is noted that the first, second, and third card contact members 61, 62, and 63 are arranged to protrude into the card accommodating space 52.

In one example, the card connector 50 may be mounted on a printed circuit board by soldering terminal portions of the card contact members 61-63 and the cover member 90, and the card loading slot 51 may be exposed at the external surface of an electronic apparatus.

The first, second, and third cards 10, 20, and may be connected by being inserted into the card loading slot 51 and pushed until reaching their respective final positions to be accommodated inside the card accommodating space 52. It is noted that a card may be inserted from any position within the card loading slot 51. In the present example, the first and third cards 10 and 30 are to be inserted with their contacts 11 and 31 facing the Z2 direction side (normal orientation). The second card 20 is to be inserted with its contact 21 facing the Z1 direction side (reversed orientation).

Figure 3A:
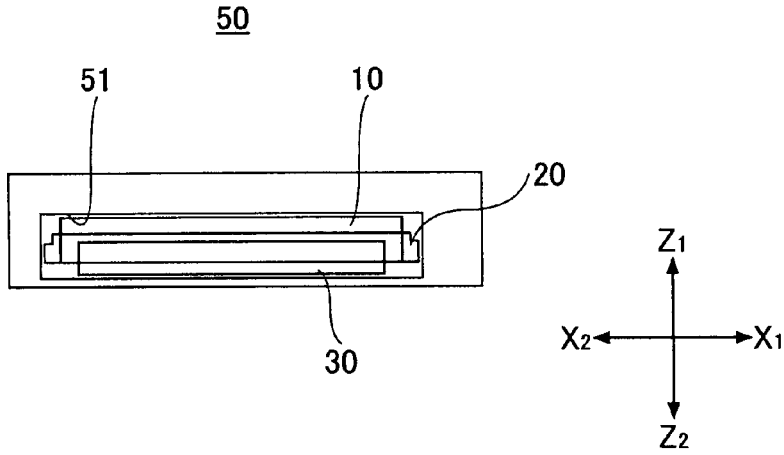
FIGS. 3A-3C are diagrams showing connection positions of the first through third cards within the card connector.
Figure 3B:
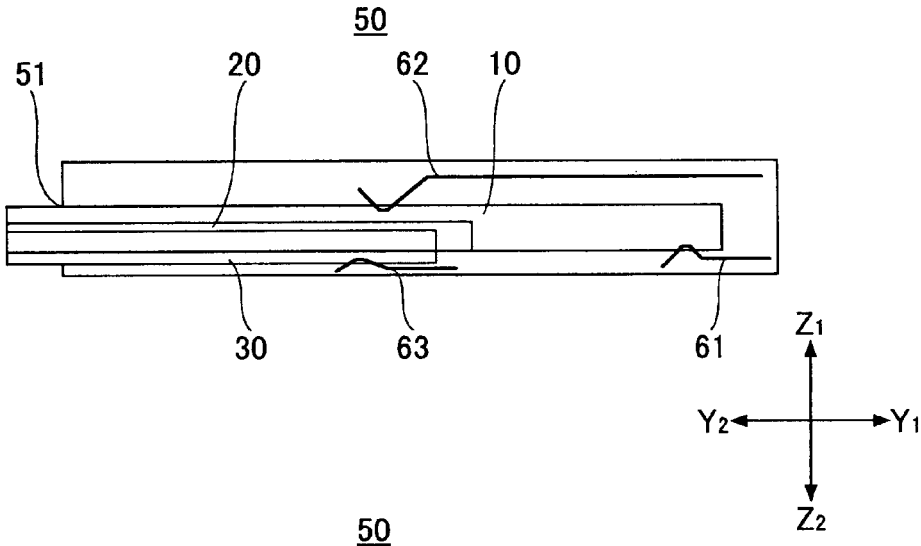
Figure 3C:
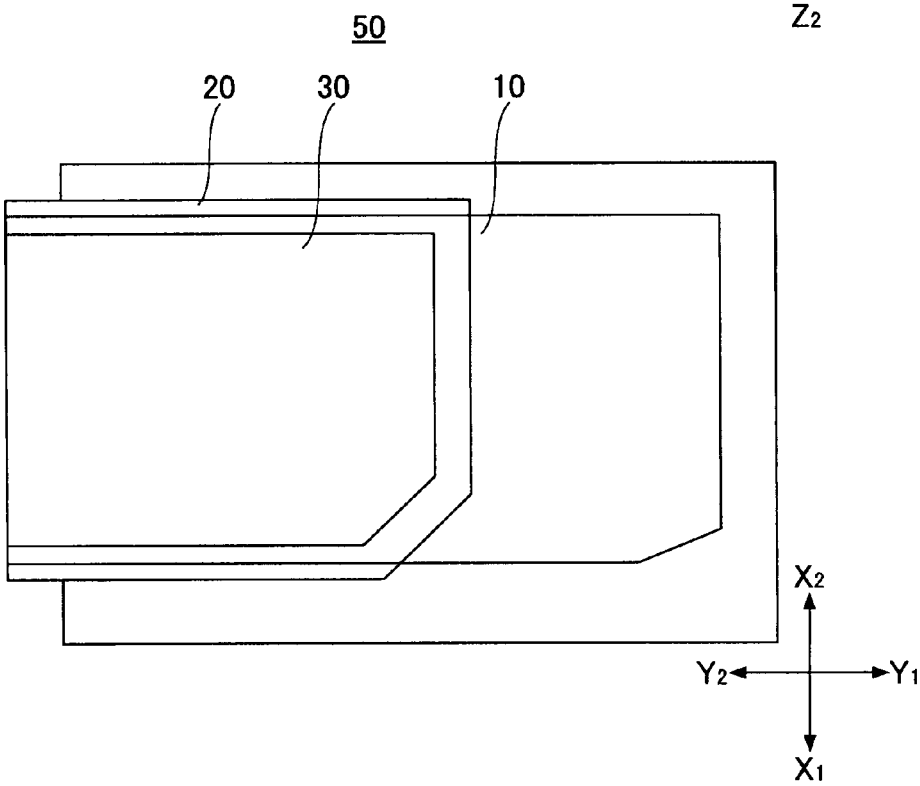

FIGS. 3A-3C illustrate connection positions of the first, second, and third cards 10, 20, and 30 within the card connector 50. As can be appreciated from these drawings, the Z2 side faces of the first and second cards 10 and 20 are positioned at the same height upon being connected to the card connector 50. The third card 30 is positioned toward the Z2 direction with respect to the first and second cards 10 and 20.

It is noted that when one of the first, second, or third card 10, 20, or 30 is connected to the card connector 50, the card loading slot 51 is closed by the Y2 edge portion of the connected card so that another card cannot be inserted into the card loading slot 51 in this case.

In one example, a connected card may be ejected by pushing the rear edge of the connected card with fingers and letting go thereafter, for example, so that the push-push type ejecting mechanism may be activated and the card may be slightly pushed out of the card loading slot 51 in the ejecting direction. In turn, a user may hold the rear edge of the card with his/her fingers to pull the card out of the card loading slot 51.

[Configuration of Memory Card Connector 50]

Figure 4A:
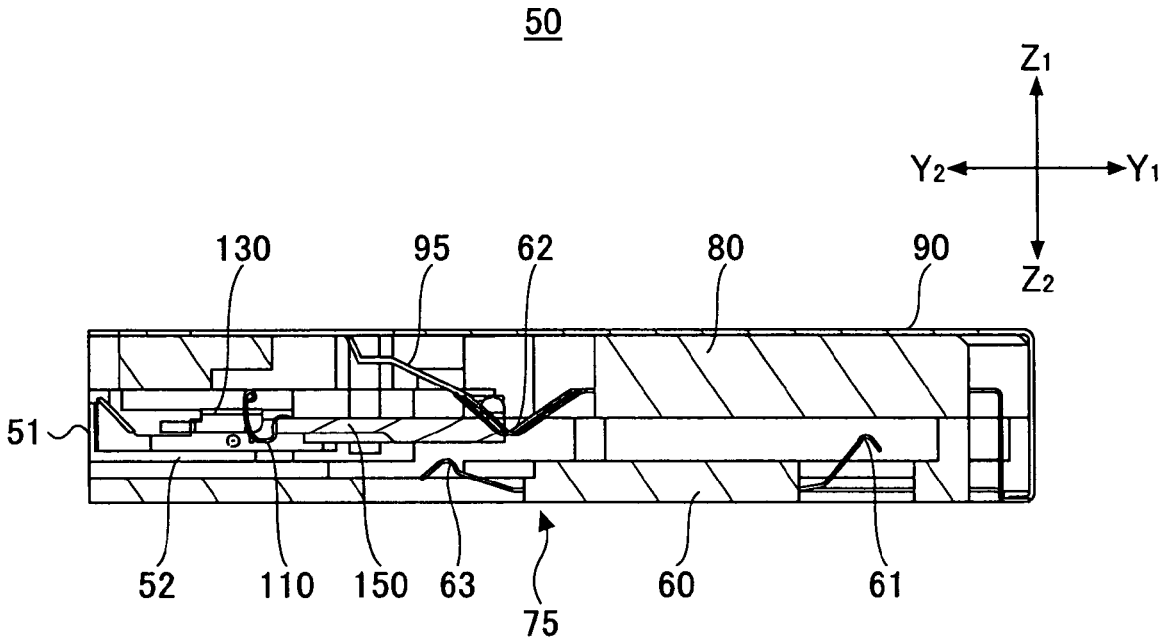
FIG. 4A is a vertical cross-sectional side view of the card connector before a card is inserted.
Figure 4B:
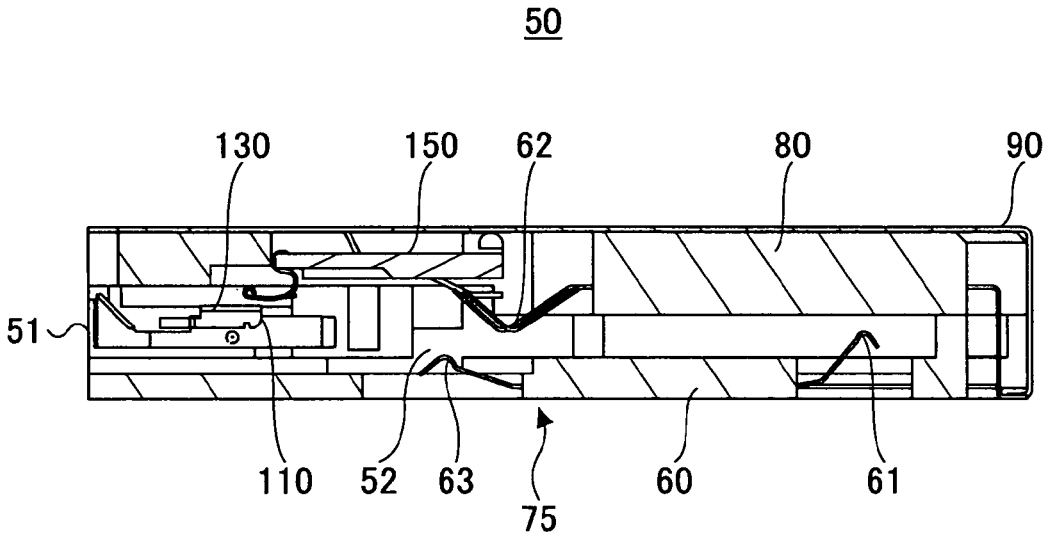
FIG. 4B is a vertical cross-sectional side view of the card connector when a regulating mechanism is operated.
Figure 5:
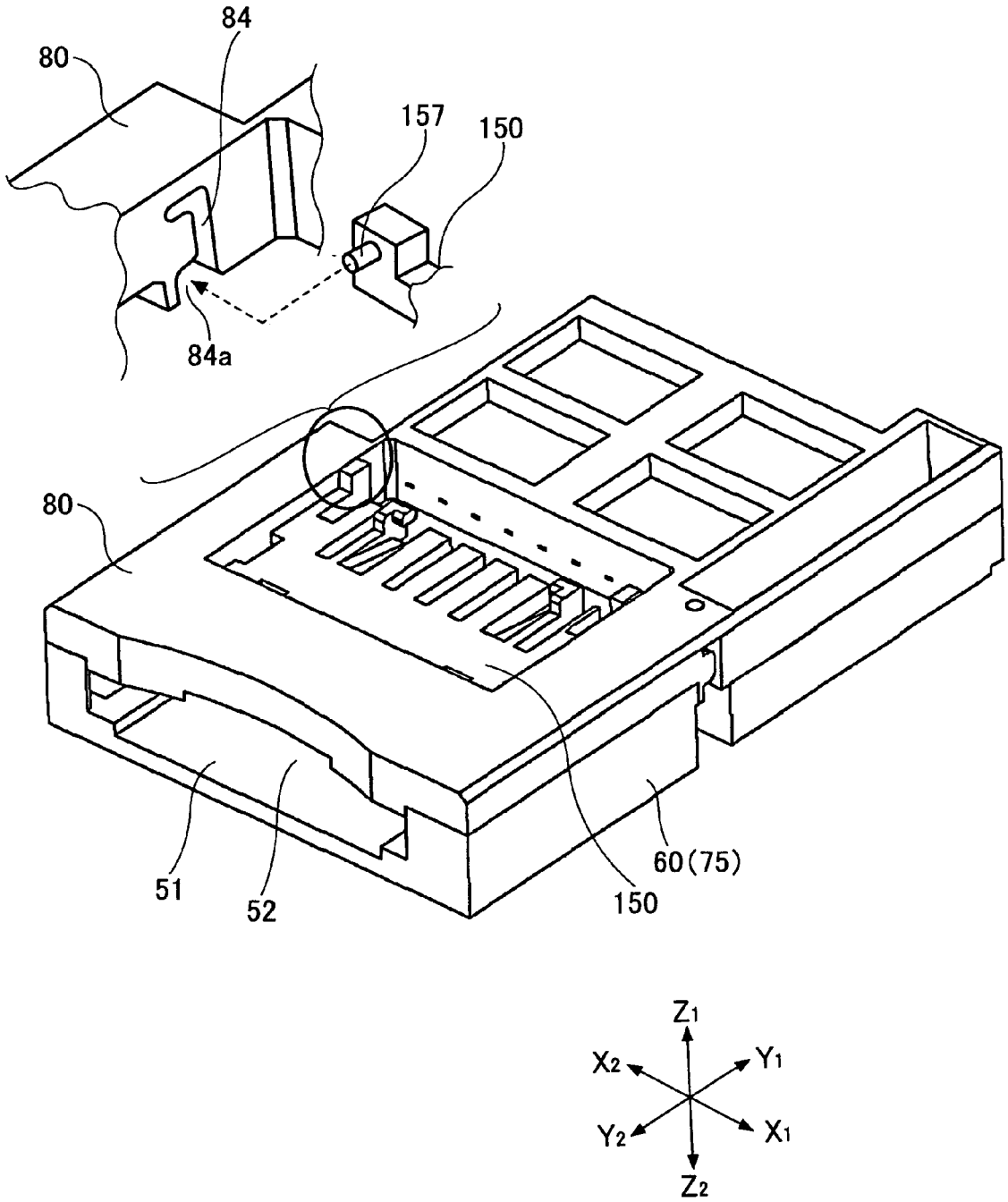
FIG. 5 is a diagram showing the card connector with its cover member removed.
Figure 6:
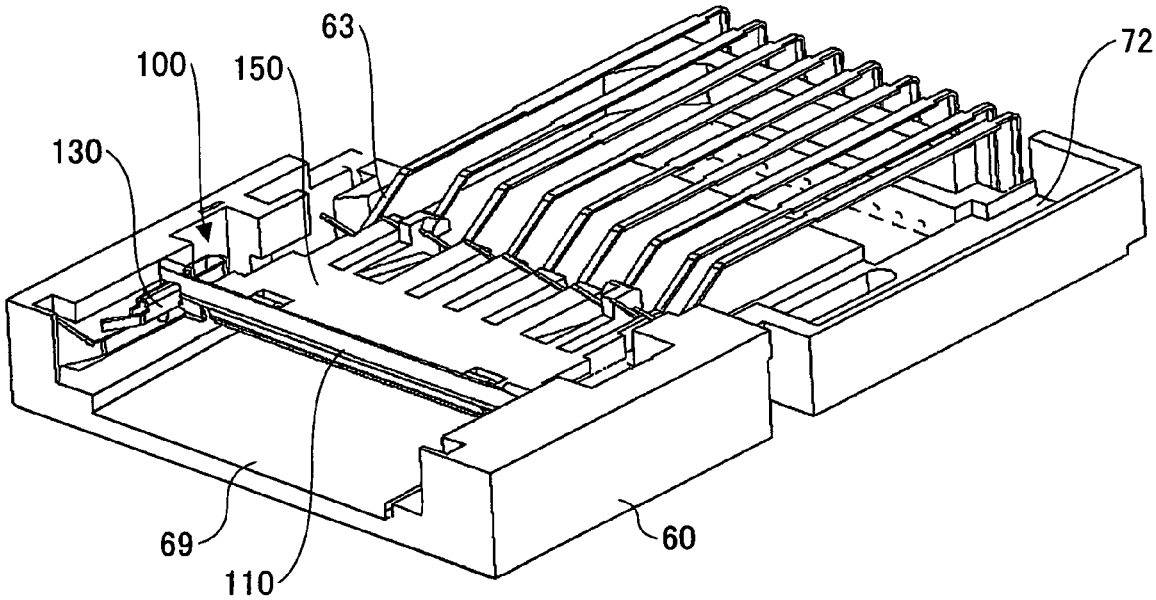
FIG. 6 is a diagram showing the card connector with its cover member and upper housing removed.
Figure 7:
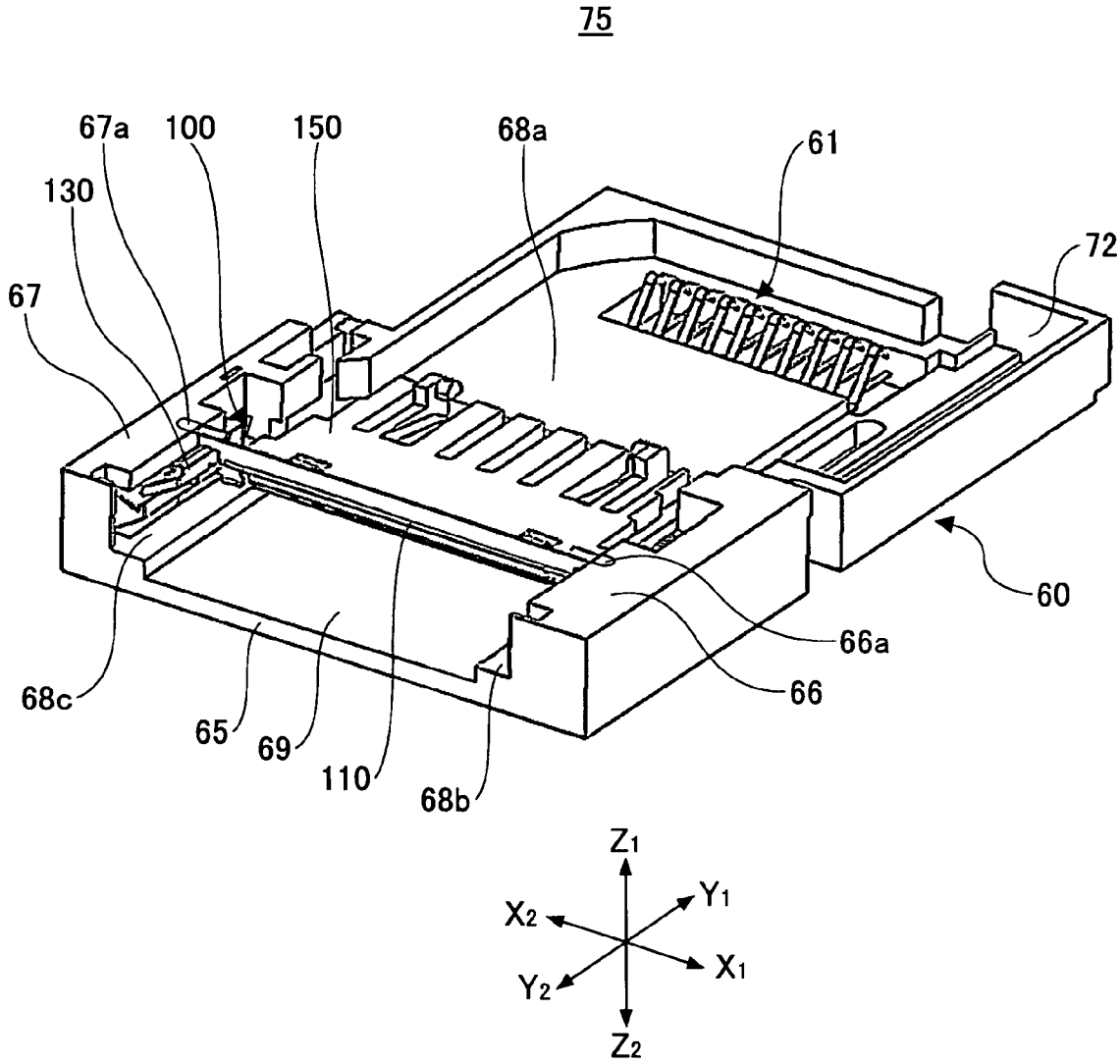
FIG. 7 is a diagram showing a lower housing module of the card connector.
Figure 8:
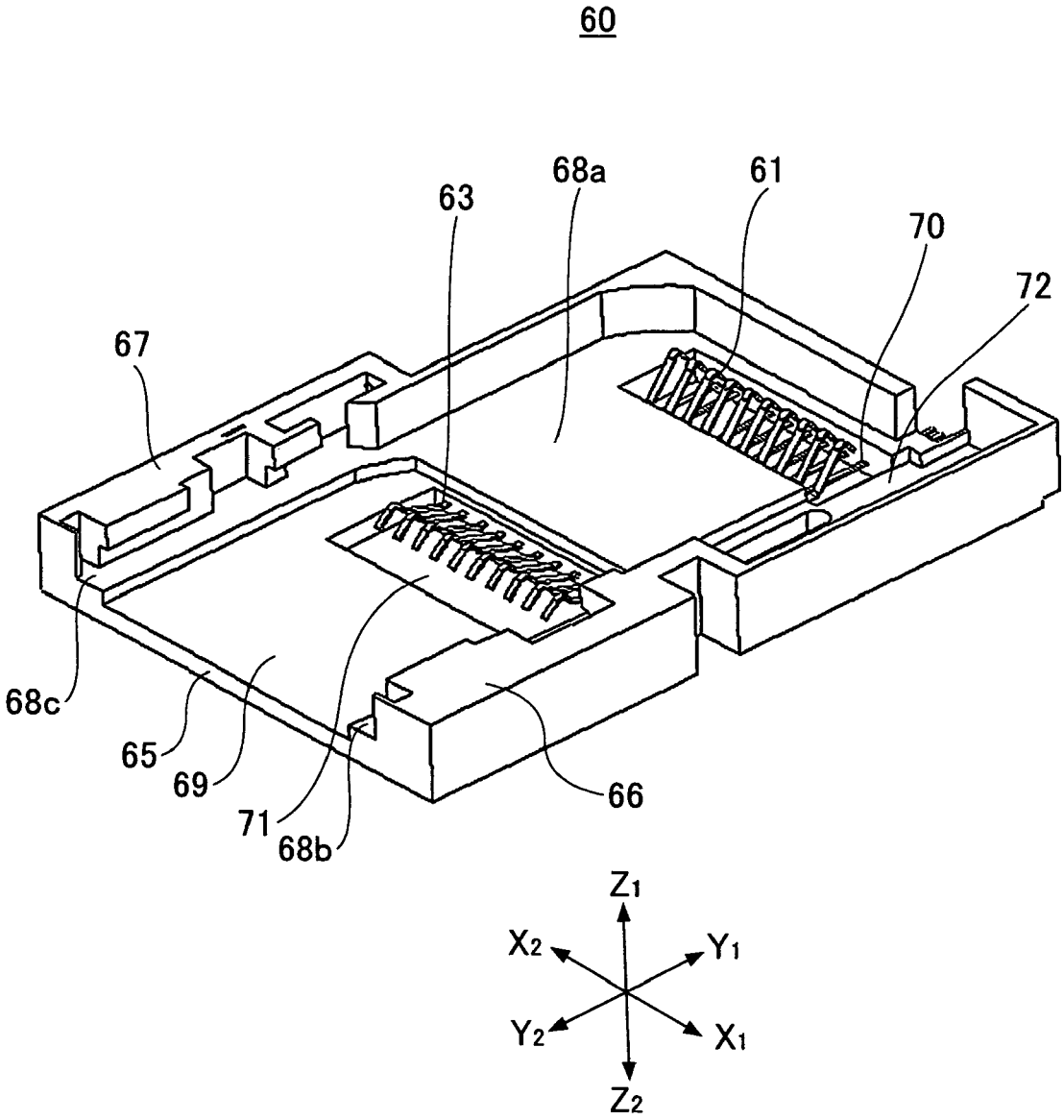
FIG. 8 is a diagram showing a lower housing of the card connector.
Figure 9:
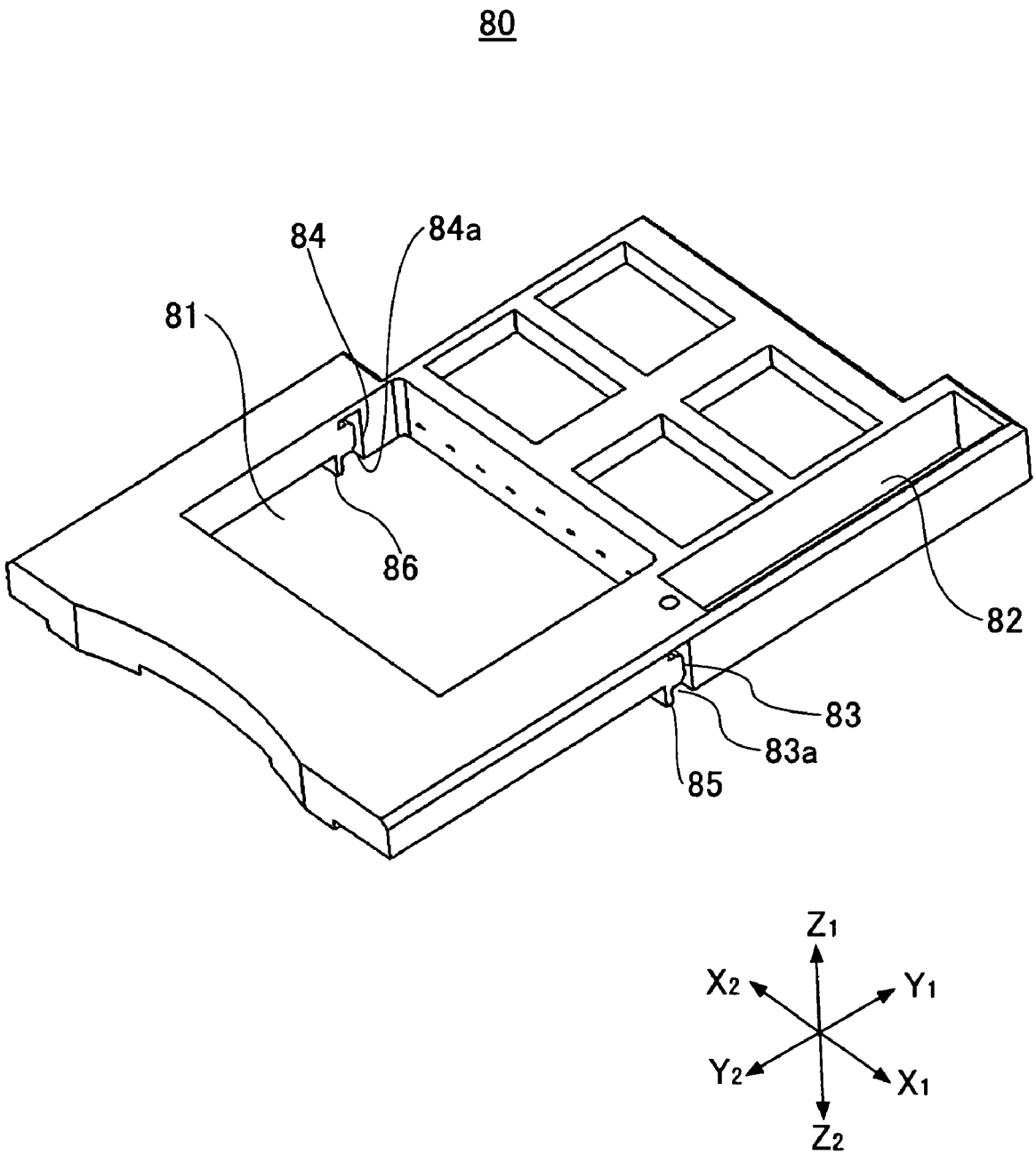
FIG. 9 is a diagram showing an upper housing of the card connector.
Figure 10:
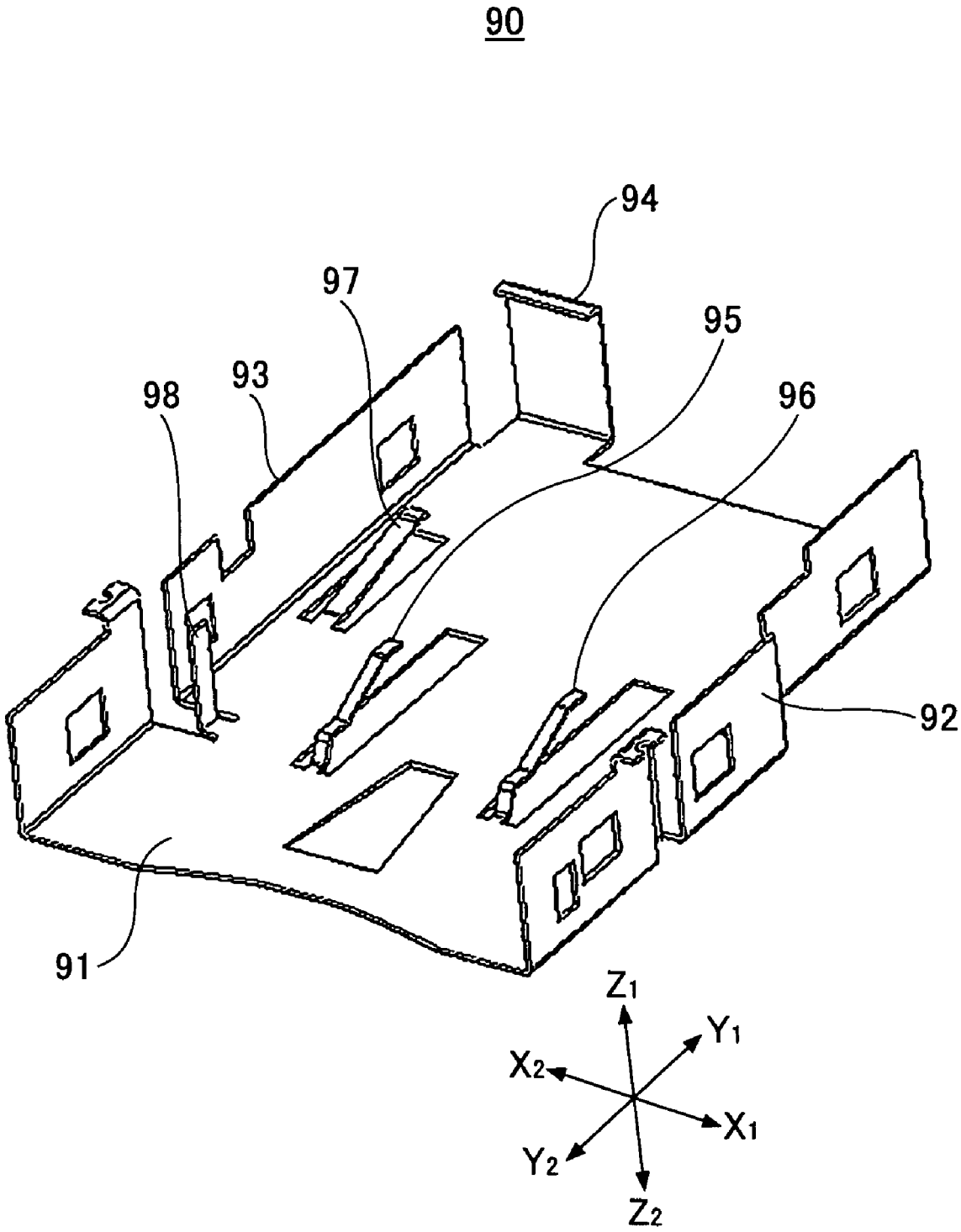
FIG. 10 is a diagram showing the cover member of the card connector turned upside down.

FIGS. 4A and 4B are vertical cross-sectional side views of the card connector 50. FIG. 4A shows the card connector 50 before a card is inserted therein, and FIG. 4B shows the card connector with a door member 110 being opened. FIG. 5 is a diagram showing the card connector 50 with the cover member 90 detached therefrom. FIG. 6 is a diagram showing the card connector 50 without the upper housing 80. FIG. 7 is a diagram showing a lower housing module 75. FIG. 8 is a diagram showing the lower housing 60. FIG. 9 is a diagram showing an upper housing 80. FIG. 10 is a diagram showing the cover member 90 turned upside down.

The lower housing 60 is a synthetic resin molded article that has the first and third card contact members 61 and 63 attached thereto through insert-molding.

As is shown in FIG. 8, the lower housing 60 includes a plate portion 65 and rail portions 66 and 67 that extend in the Y directions along the X2 side edge and X1 side edge of the plate portion 65 and has a flat U-shaped structure viewed from the Y2 side. The plate portion 65 includes support faces 68*a*, 68*b*, and 68*c* for supporting the first and third cards 10 and 30, a guide support recessed area 69, and openings 70 and 71. The support faces 68*b* and 68*c* are located at the X1 side and X2 side of the card loading slot 51. The guide support recessed area 69 is located between the support faces 68*b* and 68*c* and is recessed toward the Z2 side direction with respect to the support faces 68*b* and 68*c*. The opening 70 is for accommodating the first card contact member 61. The opening 71 is for accommodating the third card contact member 63. Also, a recessed portion 72 is arranged at the Y1 side of the rail portion 66.

The upper housing 80 is a plate-shaped synthetic resin molded article that has the second card contact member 62 arranged thereon through insert-molding.

As is shown in FIG. 9, the upper housing 80 includes openings 81, 82, and protruding pieces 85, 86. The opening 81 is configured to have the second card contact member 62 arranged therein.

Also, semi-circular grooves 83 and 84 are formed at the upper housing 80. The grooves 83 and 84 have lead portions 83*a* and 84*a* extending in the Y directions at the Z2 side. As is described in detail below, the grooves 83 and 84 are for guiding movement of pins 156 and 157 of a regulating member 150 (see FIGS. 12A and 12B). The horizontally extending lead portions 83*a* and 84*a* are for limiting displacement of the pins 156 and 157 in the Z1 direction in order to prevent the regulating member 150 from moving upward.

The upper housing 80 is positioned with respect to the lower housing 60 by the protruding pieces 86 and 87. The lead portions 83*a* and 84*a* formed by the edge portions of the grooves 83, 84, and the upper face of the lower housing 60.

The opening 82 is positioned right above the recessed portion 72, and a push-push type card ejecting mechanism using a heart cam mechanism (not shown) is arranged inside the space created by the recessed portion 72 and the opening 82.

As is shown in FIG. 10, the cover member 90 includes a top plate portion 91, side plate portions 92, 93, and a rear plate portion 94. Plate spring portions 95, 96, 97, and 98 are cut out from the top plate portion 91. The top plate portion 91 covers the upper face of the upper housing 70. The side plate portions 92, 93 and the rear plate portion 94 cover the side faces of the lower housing 60 and the upper housing 80. The plate spring portions 95 and 96 are used for recovery of the regulating member 150 as is described in detail below.

[Configuration and Operations of Regulating Mechanism 100]

Figure 11A:
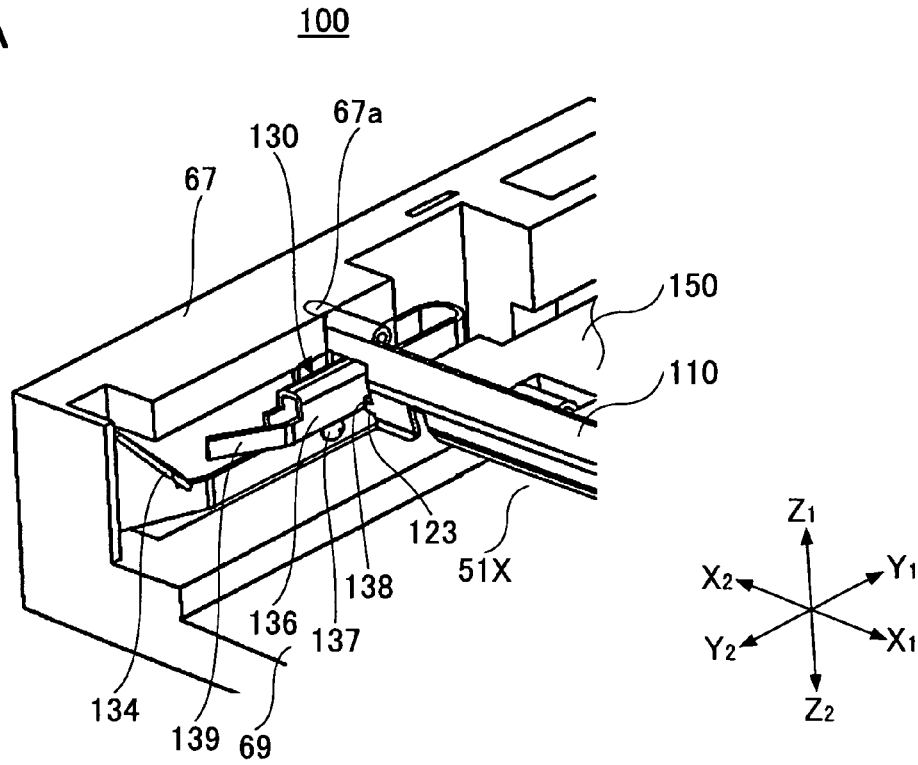
FIG. 11A is a perspective view of the regulating mechanism before operation.
Figure 11B:
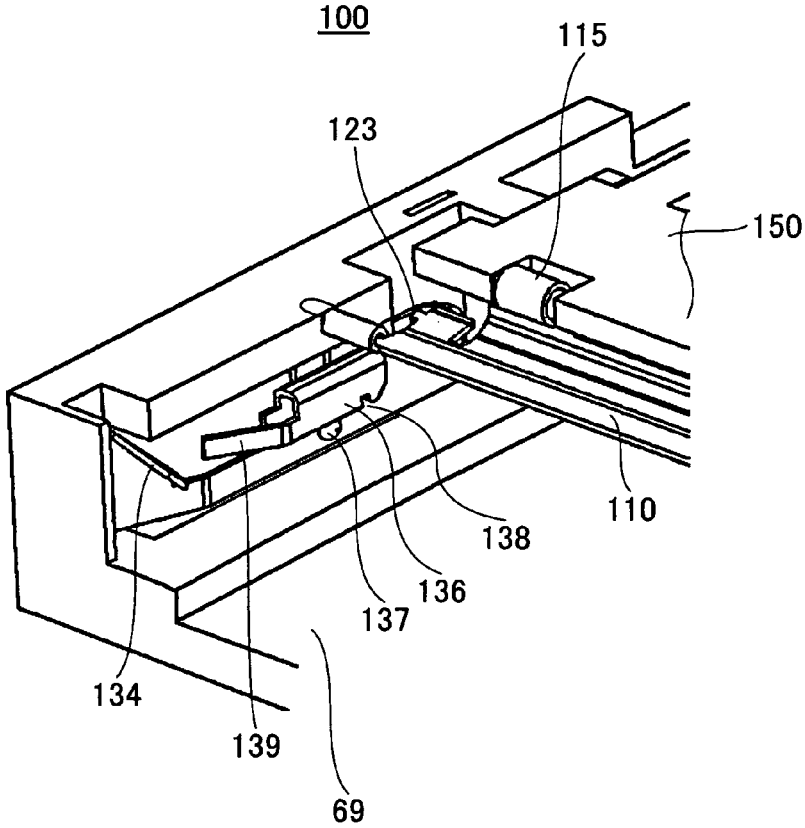
FIG. 11B is a perspective view of the regulating mechanism in operation.
Figure 12A:
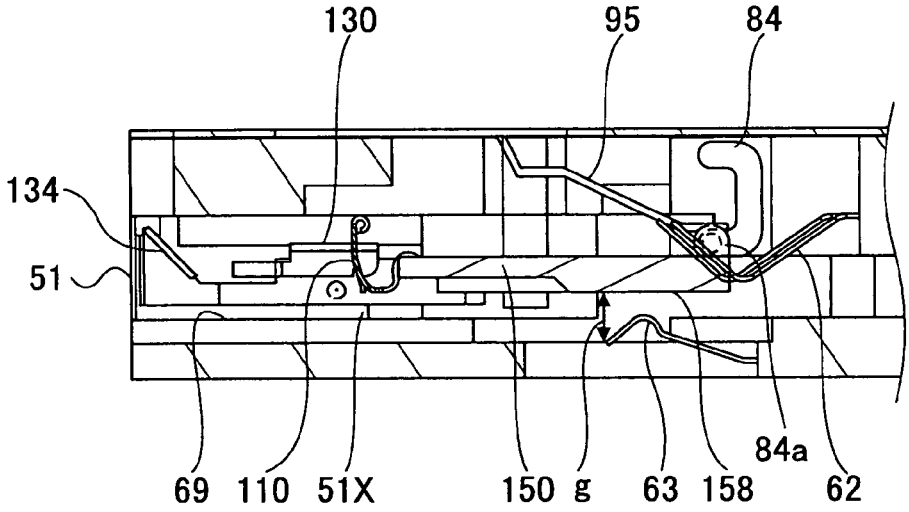
FIG. 12A is a cross-sectional view of the regulating mechanism before operation.
Figure 12B:
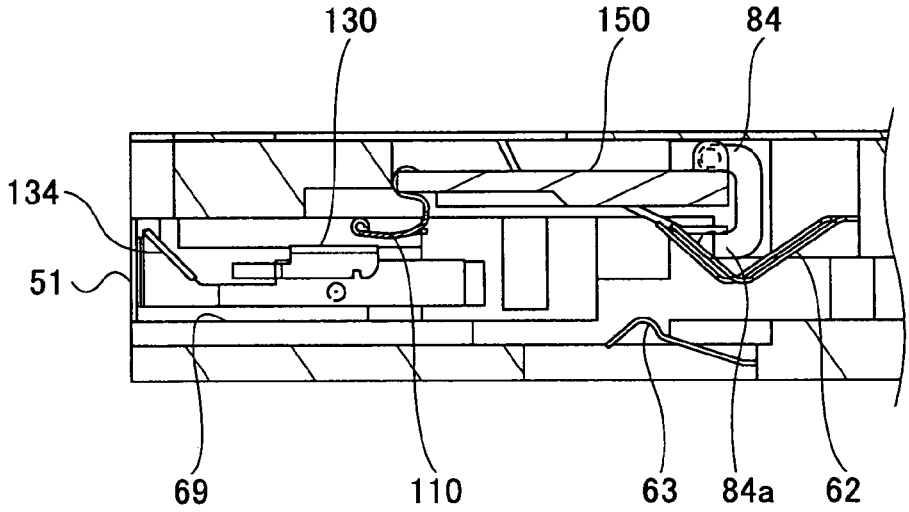
FIG. 12B is a cross-sectional view of the regulating mechanism in operation.
Figure 13A:
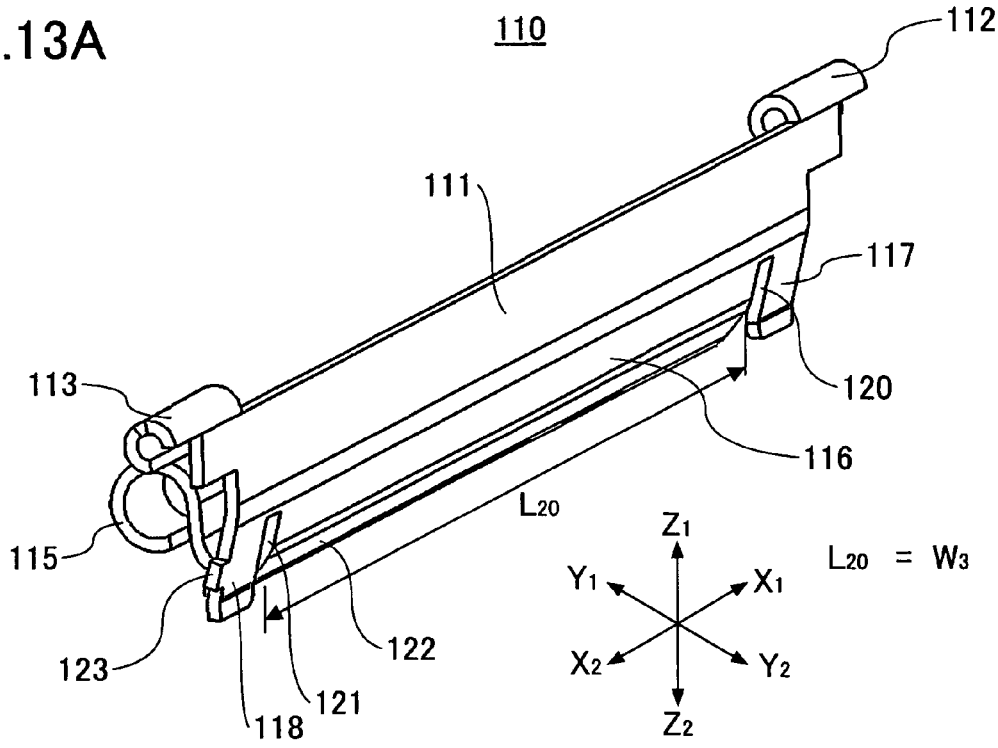
FIG. 13A is a perspective view of the door member viewed from the front side.
Figure 13B:
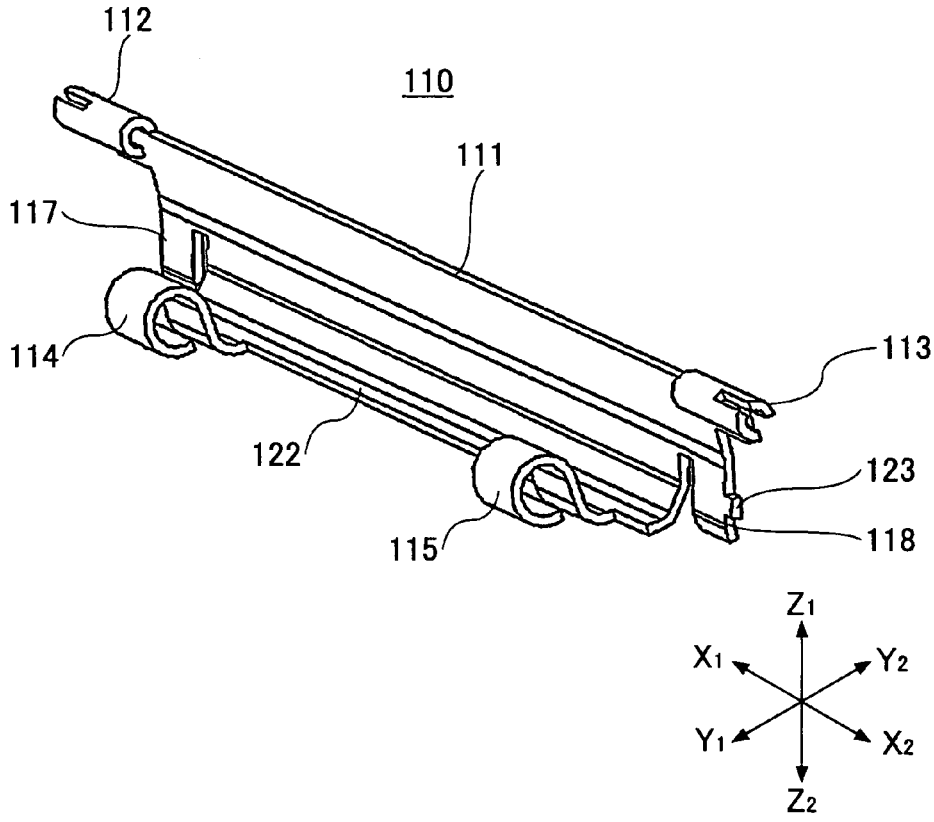
FIG. 13B is a perspective view of the door member viewed from the rear side.
Figure 14A:
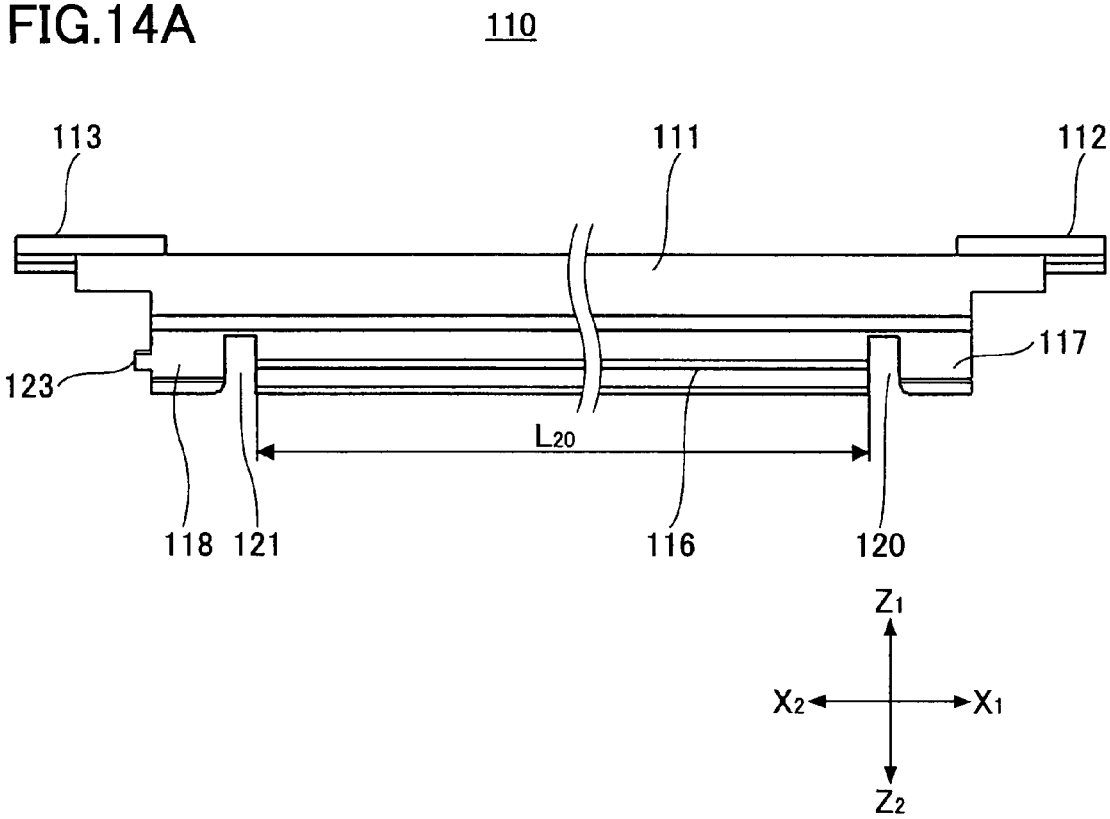
FIG. 14A is a front view of the door member.
Figure 14B:
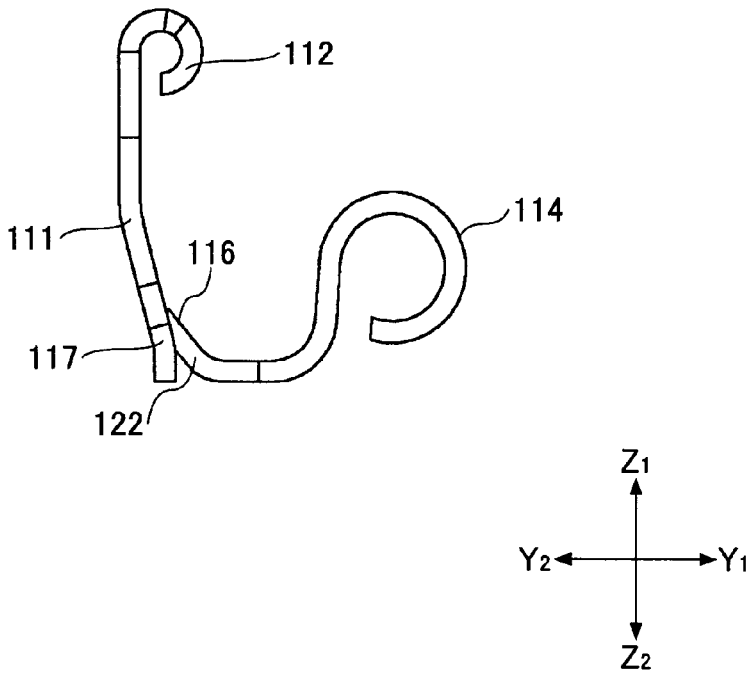
FIG. 14B is a right side view of the door member.

As is shown in FIGS. 7, 11A, 11B, 12A, and 12B, a regulating mechanism 100 is arranged at the lower housing 60. It is noted that FIGS. 11A and 12A show the regulating mechanism 100 before being operated (corresponding to FIG. 4A), and FIGS. 11B and 12B illustrate the regulating mechanism 100 in operation (corresponding to FIG. 4B).

The regulating mechanism 100 includes a door member 110, a multifunction member 130, and a regulating member 150, and is operated to control the position at which a card is connected. Specifically, when the third card 30 is inserted, the regulating mechanism 100 regulates the connection position of the third card 30. When the first card 10 is inserted, the regulating mechanism 100 guides the first card 10 to its connection position. When the second card 20 is inserted, the regulating mechanism 100 guides the second card 20 to its connection position.

FIGS. 13A, 13B, 14A, and 14B show the door member 110. The door member 110 is a press-molded metal plate member that includes a long plate portion 11 extending in the X directions, shaft portions 112 and 113 that respectively protrude in the X1 and X2 directions from the X1 and X2 side edges of the long plate portion 111 at the Z1 side, and bearing portions 114 and 115 that protrude in the Y1 direction from the Z2 side edge of the long plate portion 111.

The long plate portion 111 includes a main portion 116, and side edge portions 117 and 118. The side edge portions 117 and 118 are separated from the main portion 116 by slits 120 and 121. The main portion 116 has length L20 that is equal to the width W3 of the third card 30. The main portion 116 includes a sloped portion 122 that slopes in the direction between the Z2 direction and the Y1 direction. A lock piece 123 protruding in the X2 direction is arranged at the X2 side of the side edge portion 118.

As is shown in FIGS. 11A and 12A, the shaft portions 112 and 113 of the door member 110 engage grooves 66*a* and 67*a* respectively arranged at the upper face of the rail portions 66 and 67 (see FIG. 7) so that the door member 110 may be arranged laterally across the rails 66 and 67. The shaft portions 112 and 113 are held in place by the rail portions 66 and 67 of the lower housing 60 and the bottom face of the upper housing 80.

In the present example, when the door member 110 is vertically oriented (closed), a third card loading slot 51X having the same dimensions as the third card 30 is formed between the lower edge of the main potion 116 and the guide support recessed area 69 for enabling the third card 30 to be inserted therein.

Figure 15:
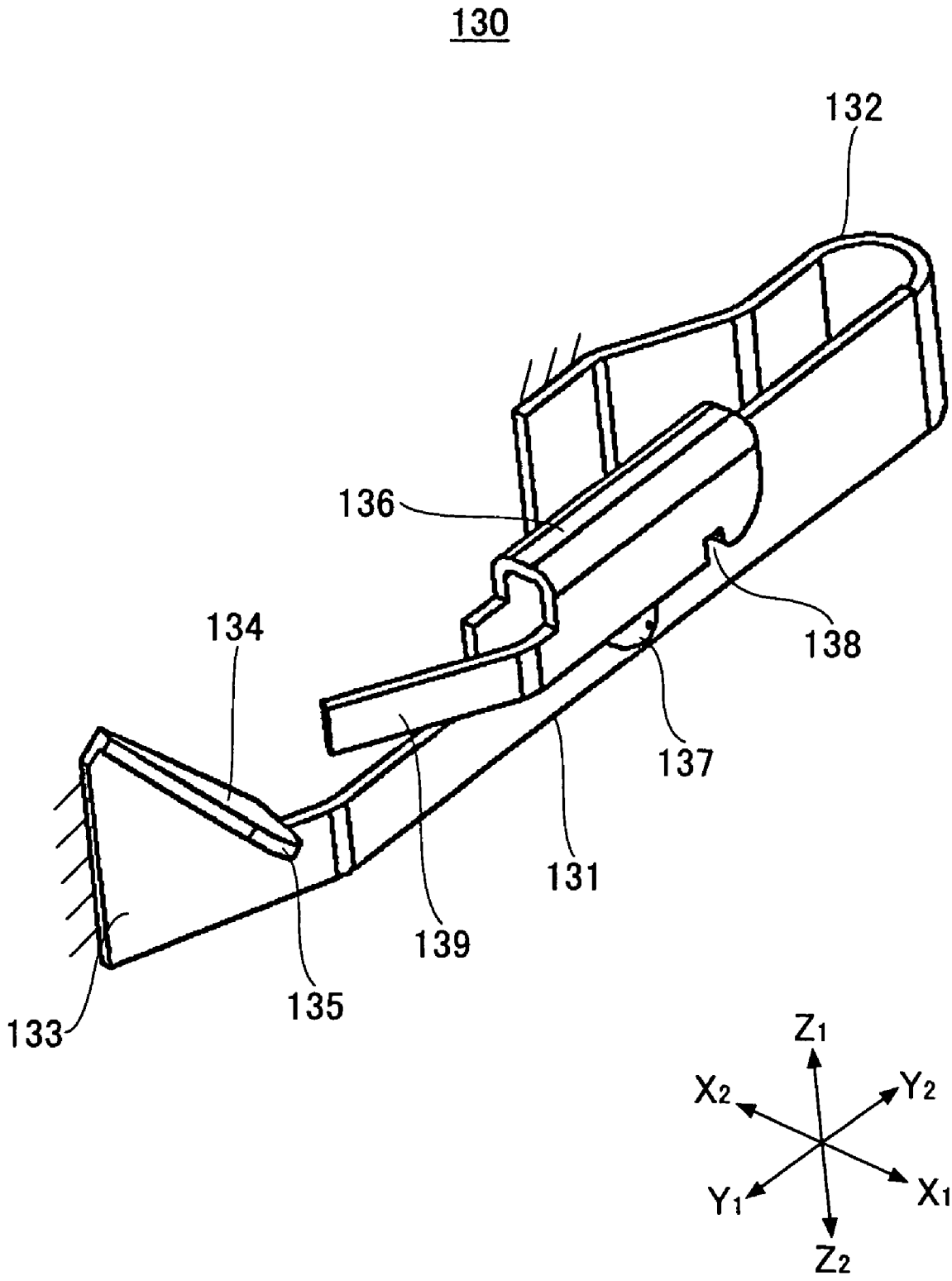
FIG. 15 is a perspective view of a multifunction member of the card connector.

FIG. 15 is a diagram showing the multifunction member 130. The multifunction member 130 has a locking function for preventing the door member 110 from opening, a lock releasing function for releasing the lock of the door member 110 when the first card 10 or the second card 20 is inserted, a first card guide function for guiding the first card 10 that is inserted, a second card guide function for guiding the second card 20 that is inserted.

The multifunction member 130 is a press-molded metal plate member that includes a main portion 131, a U-shaped portion 132 that bends toward the X2 direction from Y2 side end of the main portion 131 to form a U-shaped structure, and a diagonal portion 133 that bends diagonally in the Y1-X2 direction from the Y1 side end of the main portion 131.

It is noted that a card guide piece 134 extends in the X1 direction from the Z1 side edge of the diagonal portion 133. The card guide piece 134 is disposed diagonally such that its Y2 side slopes toward the Z2 direction. Also, the card guide piece 134 has a tip portion 135 at its X1 side edge.

At roughly a center region of the main portion 131, a curved portion 136 having a reverse U-shape structure is arranged to extend toward the X1 direction and a semispherical protruding portion 137 is arranged to protrude toward the X1 side. The curved portion 136 has a cut portion 138 for locking the door member 110. Also, a card guide piece 139 is arranged to extend in the Y1-Xx direction from the Y1 side edge of the curved portion 136.

As is shown in FIGS. 11A and 12A, the multifunction member 130 is mounted on the inner side face of the rail portion 67 of the lower housing 60 by fixing the U-shaped portion 132 and the diagonal portion 133 in place. The main portion 131 and the curved portion 136 may be displaced in the Y2 direction owing to the elastic bending properties of the U-shaped portion 132 and the diagonal portion 133. The tip portion 135 of the card guide piece 134 protrudes into the card loading slot 51 from the X2 side. The curved portion 136 and the protruding portion 137 do not extend far enough to protrude into the guide support recessed area 69 from the Z1 side.

It is noted that the lock piece 123 of the door member 110 engages the cut portion 138 of the multifunction member 130 so that the door member 110 may be locked in a close position.

Figure 16:
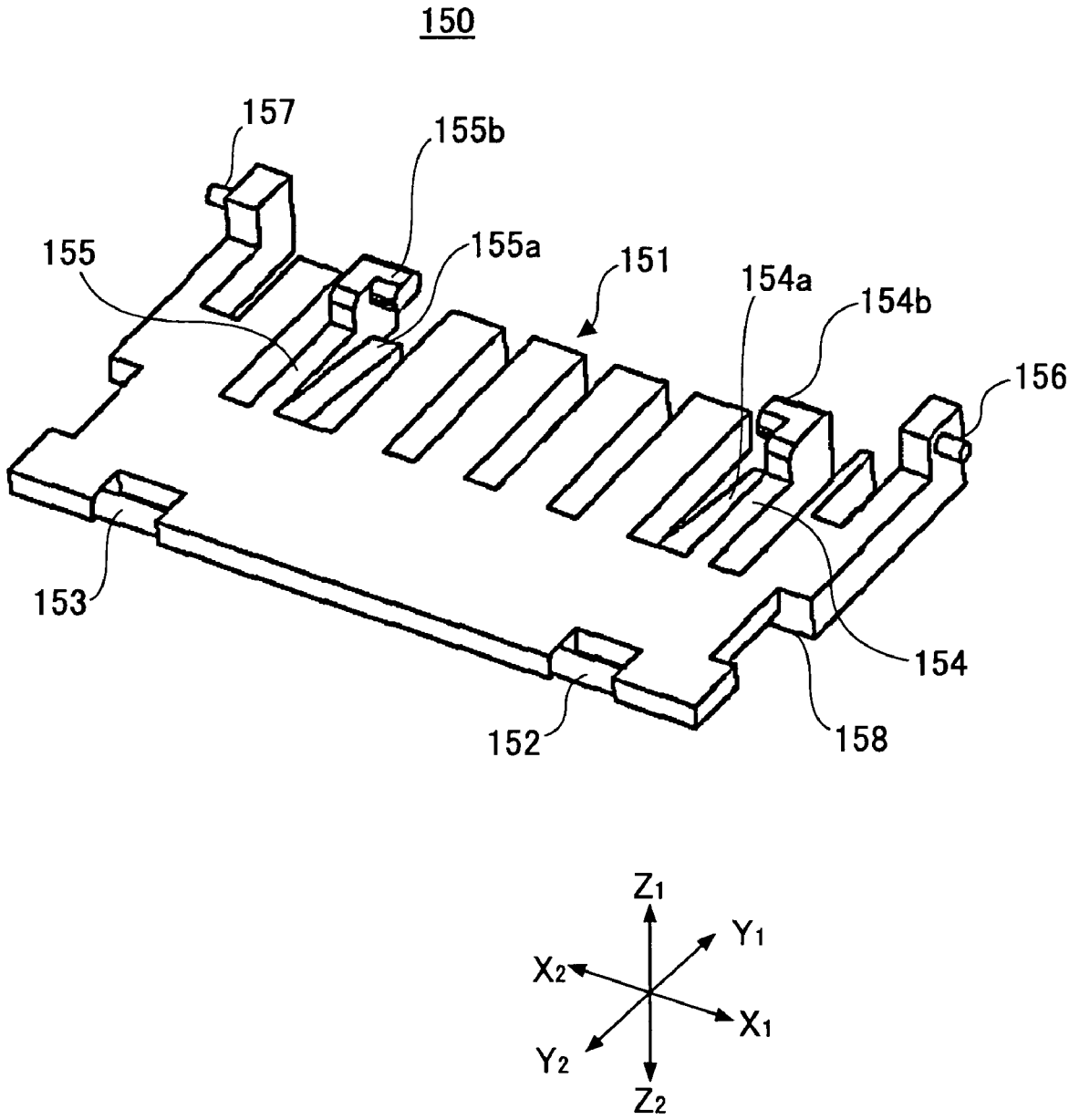
FIG. 16 is a perspective view of a regulating member of the card connector.

FIG. 16 is a diagram showing the regulating member 150 for regulating the third card 30. The regulating member 30 acts on a front edge portion of the third card 30 that is inserted to push the third card 30 in the Z2 direction. The regulating member 150 is a plate-shaped synthetic resin molded article that includes a toothed portion 151 at the Y1 side, and shaft portions 152 and 153 at the Y2 side. It is noted that the toothed portion 151 is arranged to have gaps formed between according to the configuration of the second card contact member 62. Of the plural teeth making up the toothed portion 151, teeth 154 and 155 respectively include sloped portions 154*a* and 155*a* that extend lengthwise, and protruding portions 154*b* and 155*b* arranged at the tips of the teeth 154 and 155. Also, the toothed member 151 includes pins 156 and 157 arranged at its sides. It is noted the lower face of the regulating member 150 has a stepped portion 158 thrust toward the Z2 direction arranged at the location of the toothed portion 151.

As is shown in FIGS. 11A, 12A, and 5, the regulating member 150 is horizontally disposed toward the Y1 side with respect to the position of the door member 110 and has the shaft portions 152 and 153 supported by the bearings 114 and 115, respectively, at the Y2 side, and the pins 156 and 157 engaging the lead portions 83*a* and 84*a* of the semicircular grooves 83 and 84, respectively, at the Y1 side. The Y2 side of the regulating member 150 is prevented from being displaced in the Z2 direction by being connected to the door member 110 that is locked in the closed position, and the Y1 side of the regulating member 150 is prevented from being displaced in the Z2 direction by having the pins 156 and 157 engage the lead portions 83*a* and 84*a* that extend in the Y directions. It is noted that a gap 'g' (see FIG. 12A) between the stepped portion 158 of the regulating member 150 and the guide support recessed area 69 is arranged to be equal to the thickness T3 of the third card 30. Also, the tips of the plate spring portions 95 and 96 of the cover member 90 are positioned between the sloped portion 154*a* and the protruding portion 154*b*, and the sloped portion 155*a* and the protruding portion 155*b*, respectively.

In the regulating mechanism illustrated in FIGS. 11A and 12A, when the main portion 131 of the multifunction member 130 is bent to be displaced in the X2 direction and the cut portion 138 is disengaged from the lock piece 123, the door member 110 may be rotated in the counterclockwise direction by approximately 90 degrees. When the door member 110 is rotated, the regulating member 150 moves through an arc-shaped path to be displaced in the Z1 direction while moving in the Y directions as is described in detail below.

[Connection of First Card 10]

Figures 17A, 17B:
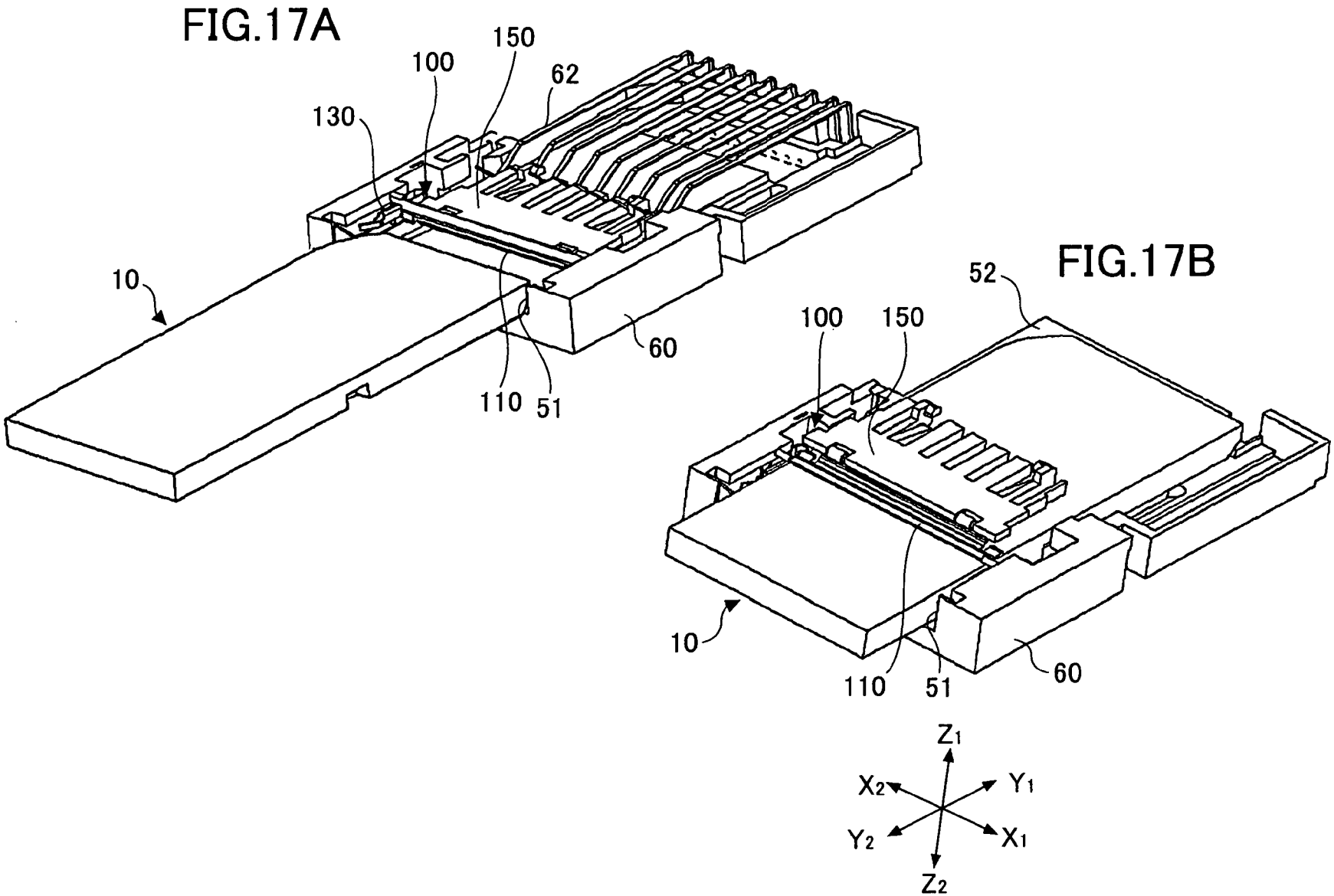
FIG. 17A is a diagram showing an initial stage of connecting the first card to the card connector.
FIG. 17B is a diagram showing the first card connected to the card connector.

FIG. 17A shows an initial stage of connecting the first card 10 to the card connector 50. FIG. 17B shows the first card 10 connected to the card connector 50.

When the first card 10 is inserted into the card loading slot 51, the X2 side front portion of the first card 10 is guided in the Z2 direction by the card guide piece 134. Then, the first card 10 is guided by the card guide piece 139 and elastically displaces the curved portion 136 in the X2 direction. At this stage, the cut portion 138 is disengaged from the lock piece 123 to release the lock of the door member 110.

Then, the front portion of the first card 10 pushes and opens the door member 110 by rotating the door member 110 in the counterclockwise direction. In turn, the regulating member 150 is pushed upward in the Z1 direction. The Y1 side edge of the regulating member 150 is moved by the pins 156 and 157 moving within the grooves 83 and 84, respectively.

As is shown in FIG. 17B, the first card 10 is inserted up to its final position to be accommodated inside the card accommodating space 52, and the contact 11 comes into contact with the first card contact member 61 (see FIG. 3B).

As is shown in FIG. 12B, the regulating member 150 may be displaced in the Z1 direction by bending the plate spring portions 95 and 96 without interfering with the second card contact member 62.

With respect to the X1-X2 directions, the first card 10 is pushed toward the X1 side by the spring force of the multifunction member 130 to be pushed and positioned on the inner face of the rail portion 66. With respect to the Z1-Z2 direction, the first card 10 is pushed by the spring force of the plate spring portions 95 and 96 to be positioned on the support face 68*a* via the regulating member 150. In this way, the contact 11 may properly come into contact with the first card contact member 61.

It is noted that the connected first card 10 may be ejected by pushing the rear end of the connected first card 10 with fingers and then letting go to activate the push-push type ejecting mechanism so that the first card 10 may be slightly pushed out. Then, the user may hold the rear end of the first card 10 with his/her fingers to pull out the first card 10 from the card connector 50.

When the first card 10 is pulled out, the regulating member 150 is displaced toward the Z2 direction by the spring force of the plate spring portions 95 and 96, and the door member 110 is rotated in the clockwise direction so that it may be closed. After the door member 110 recovers to the closed position, the curved portion 136 moves toward the X1 to recover to its original position and the cut portion 138 engages the lock piece 123 so that the door member 110 may be locked.

[Connection of Second Card 20]

Figures 18A, 18B:
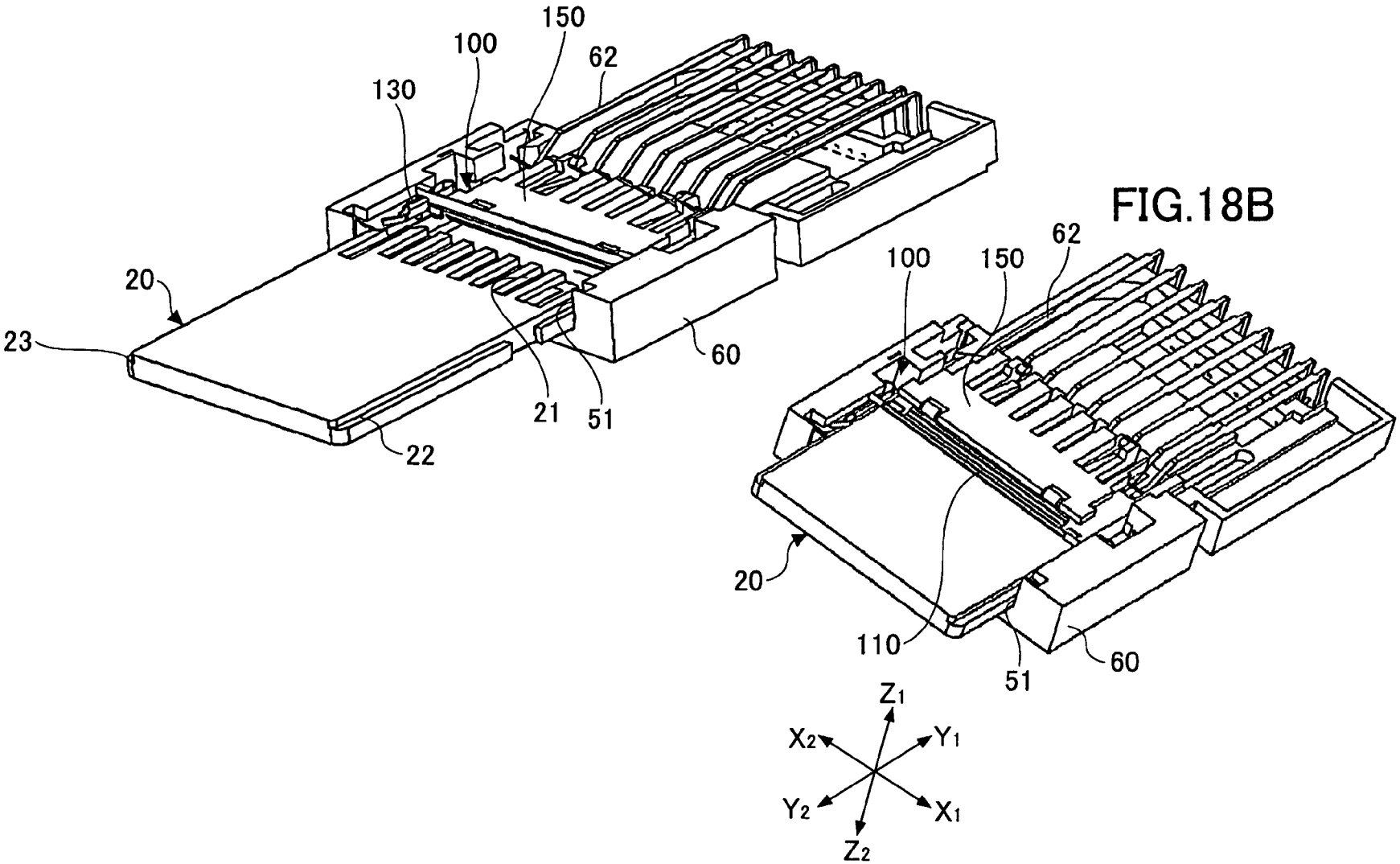
FIG. 18A is a diagram showing an initial stage of connecting the second card to the card connector.
FIG. 18B is a diagram showing the second card connected to the card connector.

FIG. 18A shows an initial stage of connecting the second card 20 to the card connector 50, and FIG. 18B shows the second card connector 20 connected to the card connector 50.

The second card 20 is turned upside down upon being inserted into the card loading slot 51. The second card 20 has stepped grooves 22 and 23 respectively formed along the X1 and X2 side edges of its Z1 side face. When the second card 20 is inserted into the card loading slot 51, the stepped groove 23 is guided toward the Z2 direction by the card guide piece 134, and the second card 20 is maintained at this height position thereafter. The X2 side edge of the second card 20 pushes the protruding portion 137 and elastically displaces the curved portion 136 in the in the X2 direction to bend the main portion 131. At this stage, the lock of the door member 110 is released.

It is noted that the process of connecting the second card 20 to the card connector 50 after the above steps is similar to that for connecting the first card 10 to the card connector 50. That is, the front portion of the second card 20 pushes and rotates the door member 110 in the counterclockwise direction and pushes the regulating member 150 upward in the Z1 direction.

As is shown in FIG. 18B, the second card 20 is inserted up to its final position to be accommodated inside the card accommodating space 52, and the contact 21 comes into contact with the second card contact member 62 (see FIG. 3B).

As is shown in FIG. 12B, the regulating member 150 may be displaced in the Z1 direction by bending the plate spring portions 95 and 96 without interfering with the second card contact member 62.

It is noted that the connected second card 20 may be ejected by the same ejection operations performed on the first card 10 as is described above. In turn, the regulating member 150 and the door member 110 may return to their original positions so that the door member 110 may be locked.

[Connection of Third Card 30]

Figure 19A:
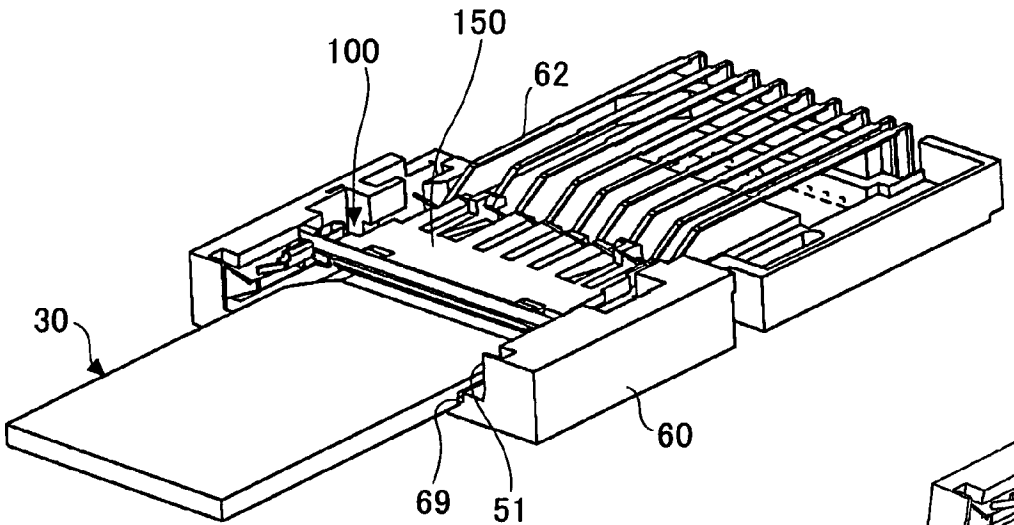
FIG. 19A is a diagram showing an initial stage of connecting the third card to the card connector.
Figure 19B:
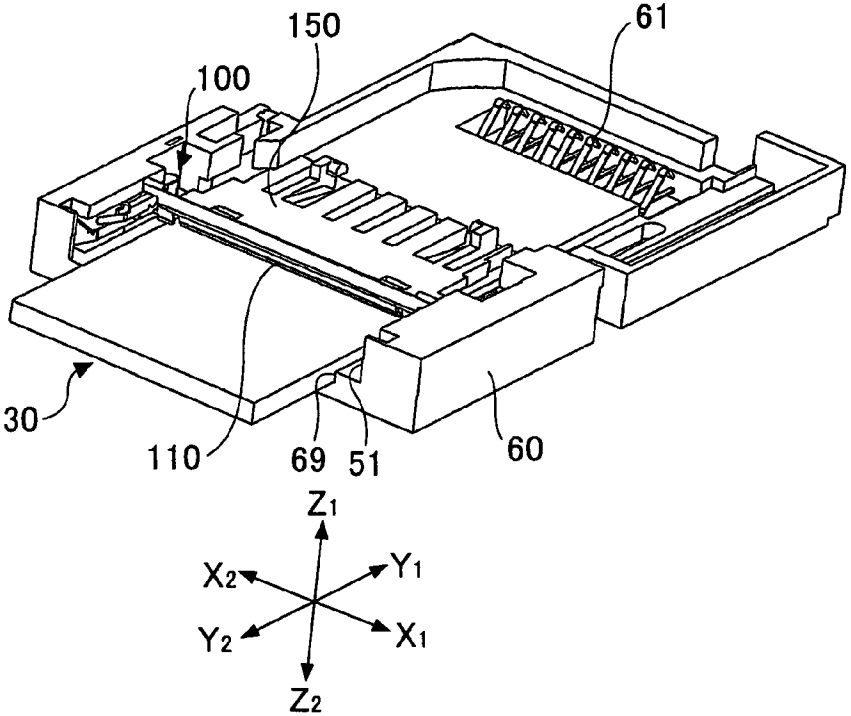
FIG. 19B is a diagram showing the third card connected to the card connector.

FIG. 19A shows an initial stage of connecting the third card 30 to the card connector 50, and FIG. 19B shows the third card 30 connected to the card connector 50.

In FIG. 19A, the door member 110 is locked in the closed position and both the Y1 side and the Y2 side of the regulating member 150 are prevented from being displaced in the Z2 direction.

As is shown in FIG. 19A, the third card 30 is arranged to fit into the guide support recessed area 69 upon being inserted into the card loading slot 51. The third card 30 is inserted into the card loading slot 51 without coming into contact with the multifunction member 130. Thus, the door member 110 remains locked in the closed position.

The third card 30 passes the third card loading slot 51X and reaches its final position to be accommodated inside the card accommodating space 52.

Figure 20:
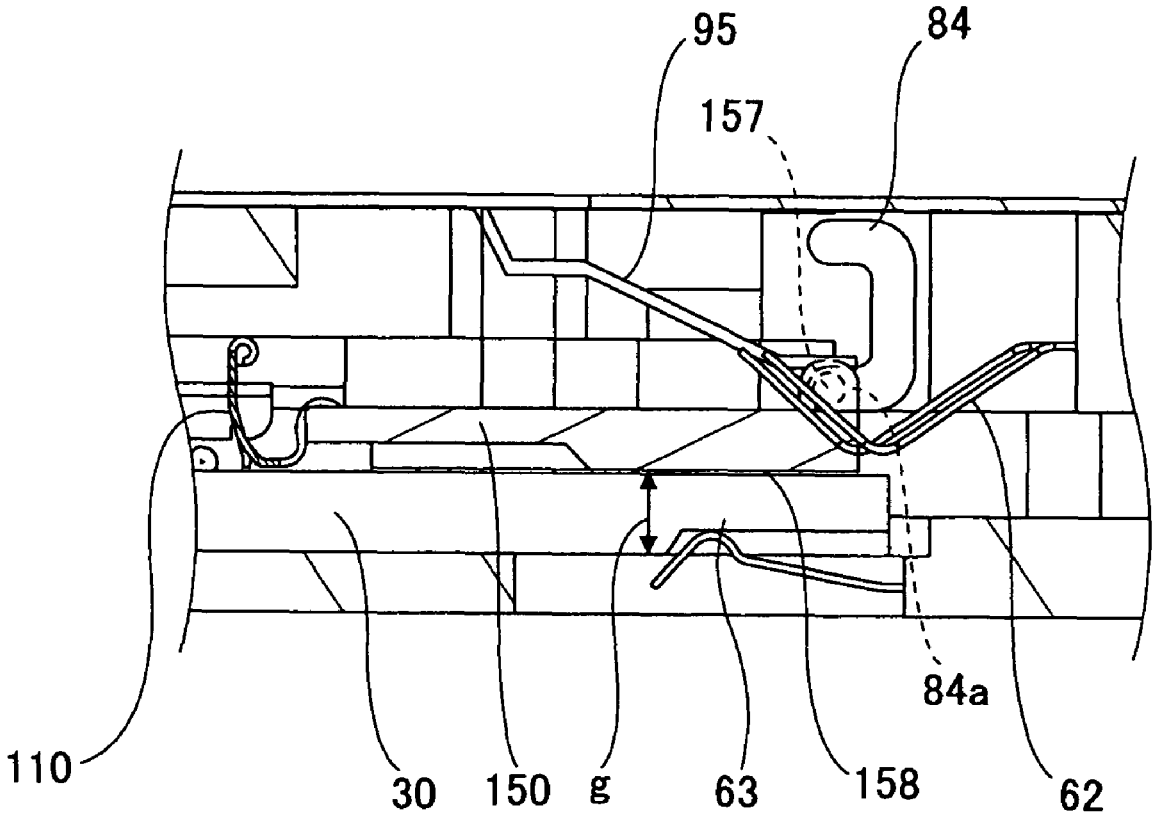
FIG. 20 is a diagram showing the regulating member regulating movement of the third card.

As is shown in FIG. 20, the front portion of the third card 30 that passes the third card loading slot 51X enters the space located below the stepped portion 158 of the regulating member 150 so that its upper face is held by the regulating member 150 to be prevented from moving upward in the Z1 direction. In this way the contact 31 may properly come into contact with the third card contact member 63.

It is noted that the connected third card 30 may be ejected in a manner similar to that for ejecting the first card 10 as is described above.

Second Embodiment

Figure 21:
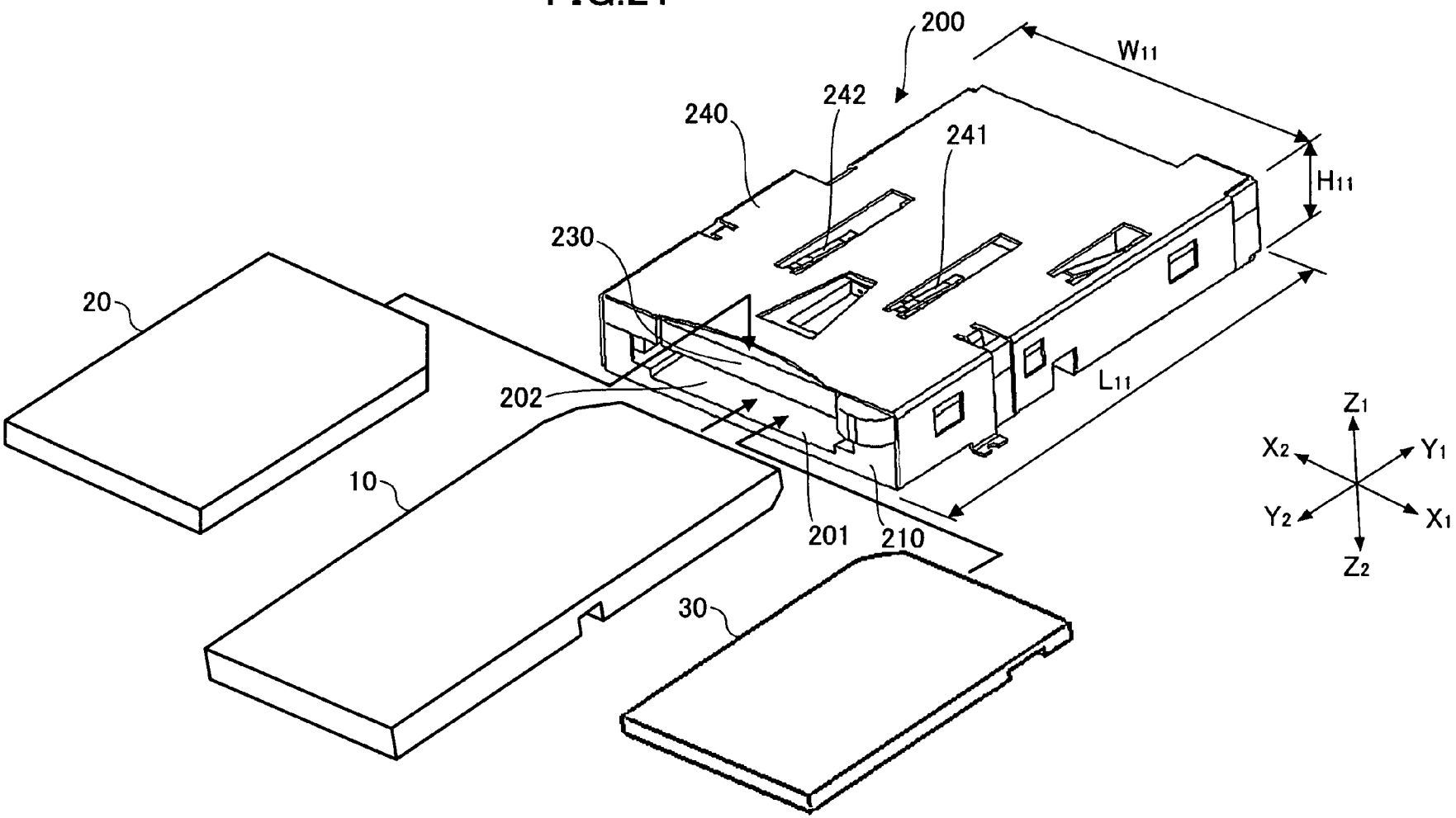
FIG. 21 is a diagram showing a card connector according to a second embodiment of the present invention in relation to the first through third cards.
Figure 22:
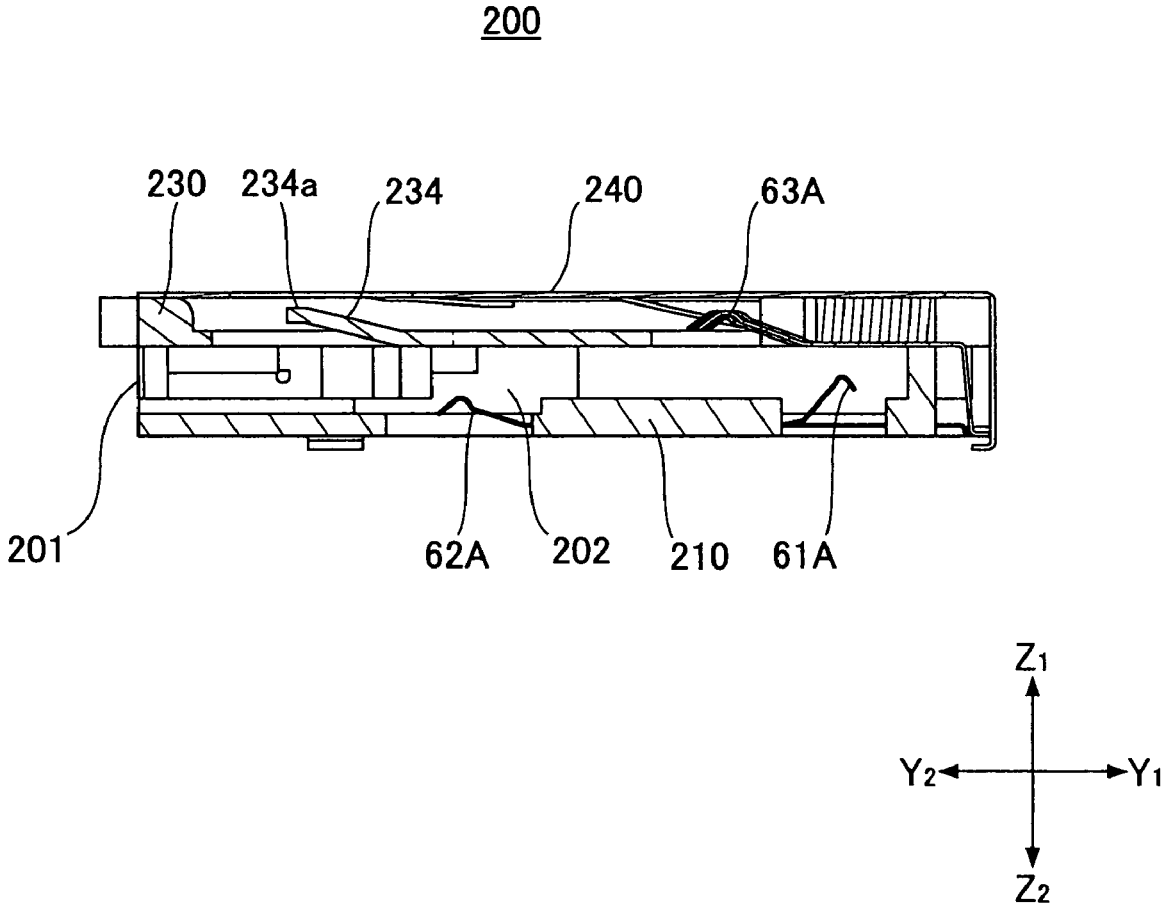
FIG. 22 is a vertical cross-sectional view of the card connector according to the second embodiment.
Figure 23:
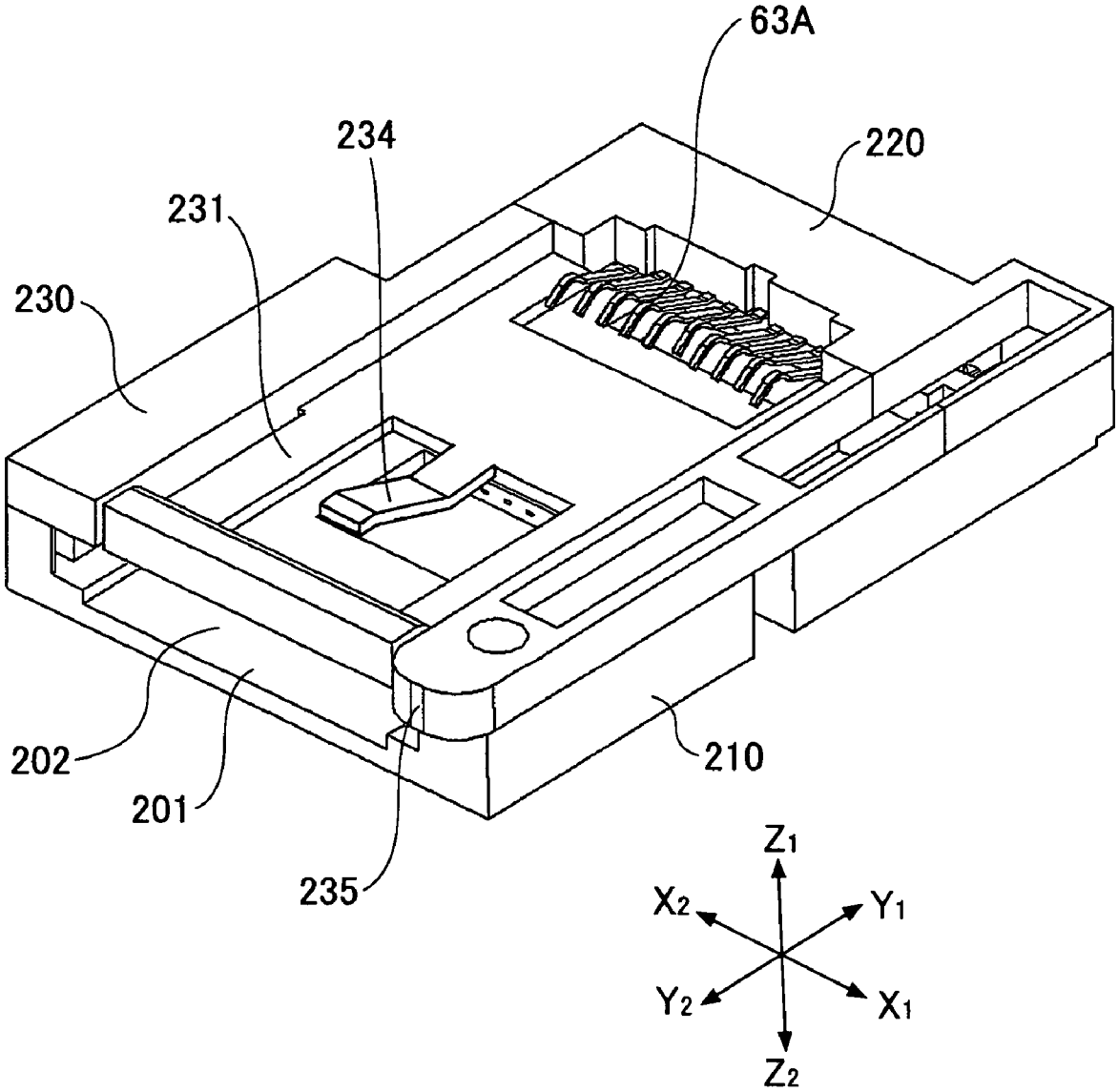
FIG. 23 is a diagram showing the card connector according to the second embodiment with its cover member removed.
Figure 24:
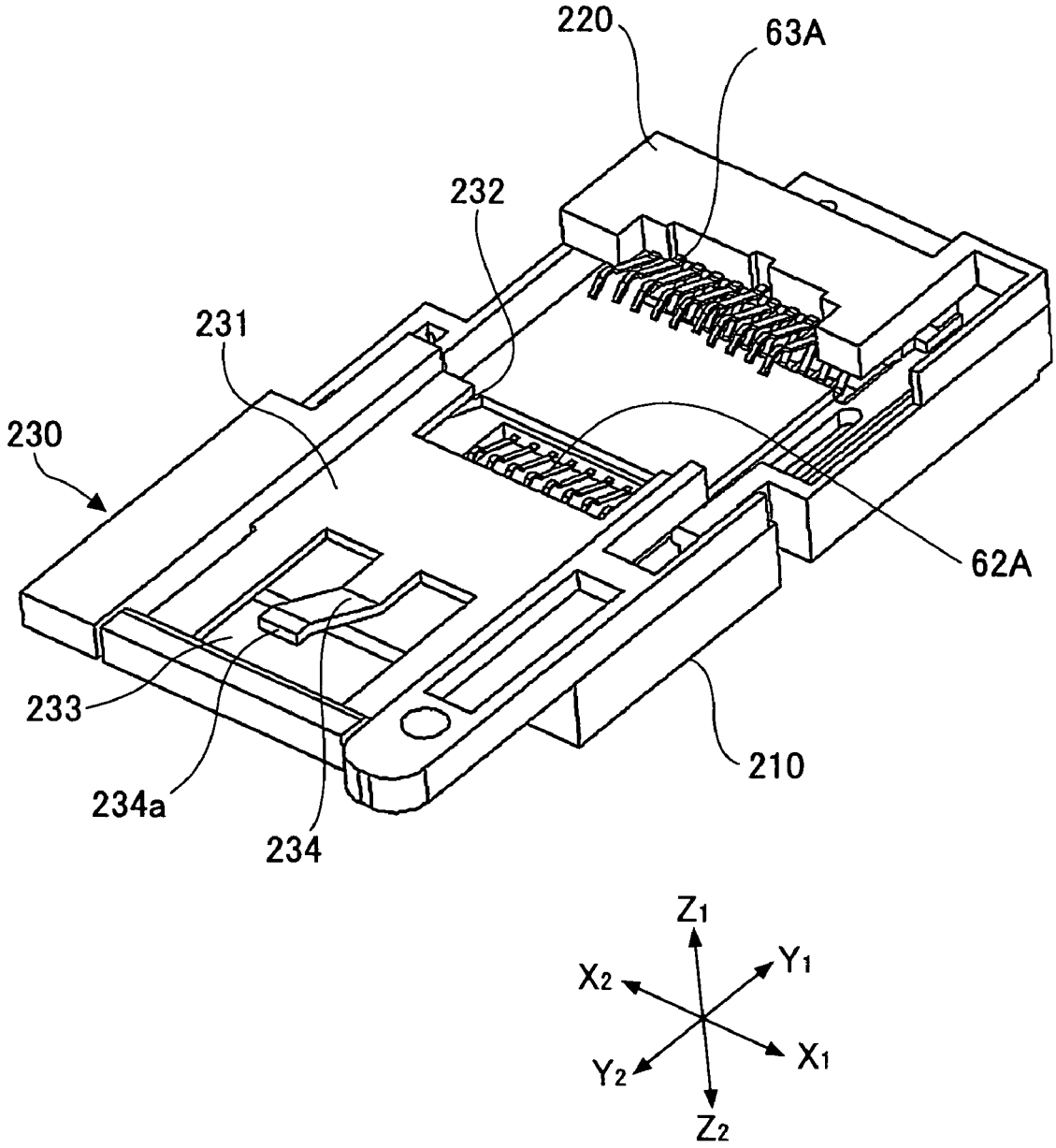
FIG. 24 is a diagram showing the card connector with its third card tray thrust out.
Figure 25:
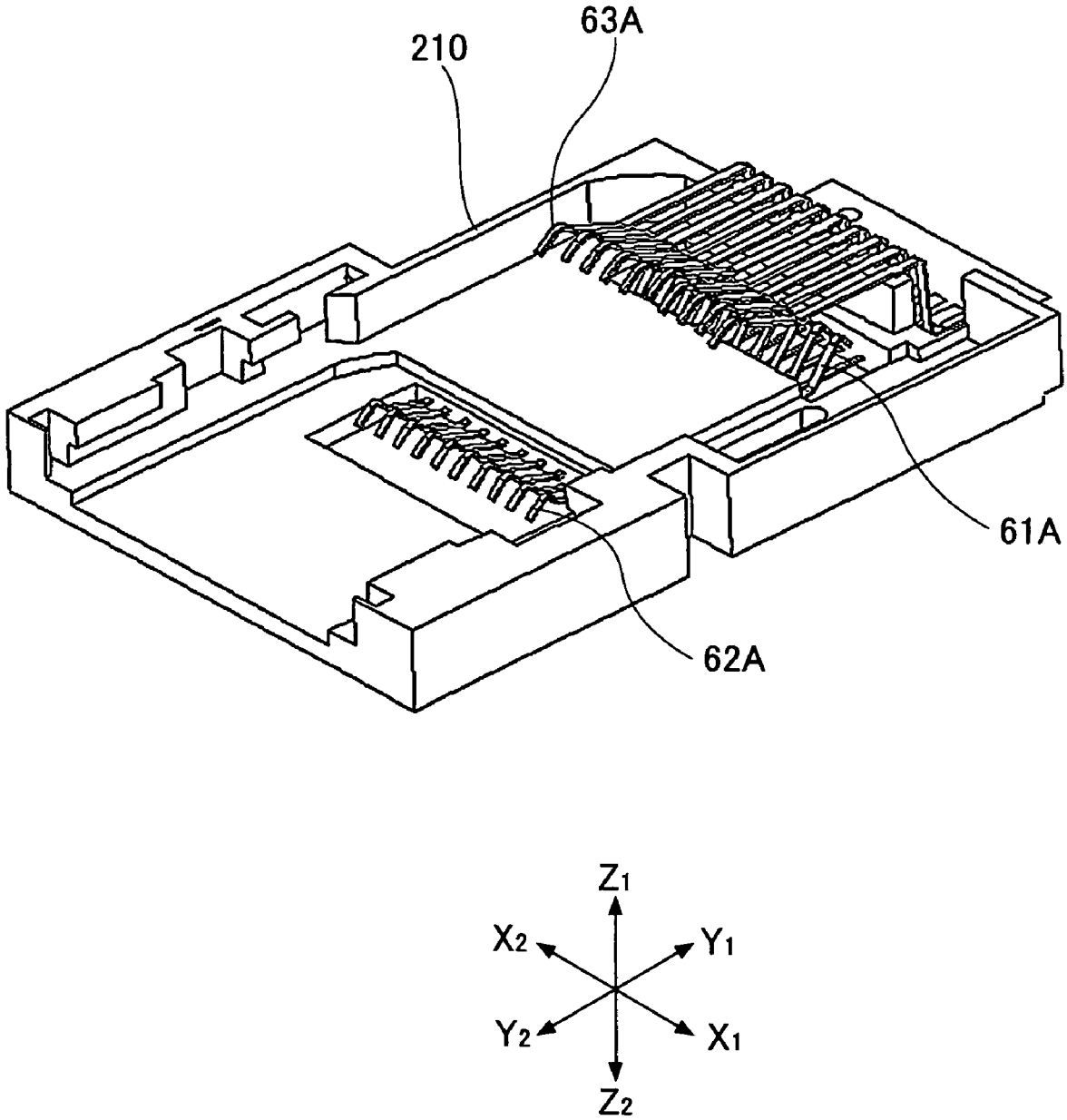
FIG. 25 is a diagram showing a housing of the card connector according to the second embodiment.

FIG. 21 is a diagram showing a card connector 200 according to a second embodiment of the present invention in relation to the first through third card connectors 10-30. FIG. 22 is a vertical cross-sectional view of the card connector 200. FIG. 23 is a diagram showing the card connector 200 with its cover member removed. FIG. 24 is a diagram showing the card connector 200 with its third card tray 230 thrust out. FIG. 25 is a diagram showing a housing 210 of the card connector 200.

The card connector 200 has a flat rectangular cubic structure with length L11, width W11, and height H11. The card connector 200 includes a housing 210, a contact holder member 220 that is fixed to the Y1 side upper face of the housing 210, a third card tray 230 arranged on the Y2 side upper face of the housing 210, and a metal plate cover member 240 that covers that housing 210, the contact holder member 220, and the third card tray 230. Also, the card connector 200 has a common card loading slot 201 for the first card 10 and the second card 20, and a card accommodating space 202 that is connected to the card loading slot 201. In the present embodiment, the third card tray 230 may be moved in the Y1-Y2 directions to be positioned over or away from the Z1 side (upper side) of the card accommodating space 202.

As is shown in FIG. 25, the housing 210 is a resin molded article that has a first card contact member 61A and a second card contact member 62A attached thereto through insert-molding. It is noted that in FIG. 25, a third contact member 63A is also shown for the sake of convenience.

As is shown in FIGS. 23 and 24, the contact holder member 220 is a resin molded article that has the third contact member 63A attached thereto through insert-molding.

The third card tray 230 is a resin molded article that has a recessed portion 231 corresponding to the dimensions of the third card 30. The recessed portion 231 has a cut portion 232 at its Y1 side for the third card contact member 63A. Also, the recessed portion 231 has an opening 233 and an extended piece 234 that extends from the Y1 side toward the Y2 side within the opening 233. The extended piece 234 is a cantilever beam having spring characteristics. A tip portion 234*a* of the extended piece 234 is arranged at a height toward the Z1 direction with respect to the height position of the upper face of the recessed portion 231. As is described below, the extended piece 234 acts as a regulating member that prevents the third card 30 from being connected when the first or second card 10/20 is connected and prevents the first or second card 10/20 from being connected when the third card 30 is connected. Also, the third card tray 230 has a protruding portion 235 at its Y2 side edge toward the X1 side.

As is shown in FIG. 21, the cover member 240 includes plate spring portions 241 and 242 for holding the third card 30.

Also, it is noted that the card connector 200 according to the present embodiment includes a push-push type ejecting mechanism (not shown) in its interior.

[Connection of First Card 10]

Figure 26:
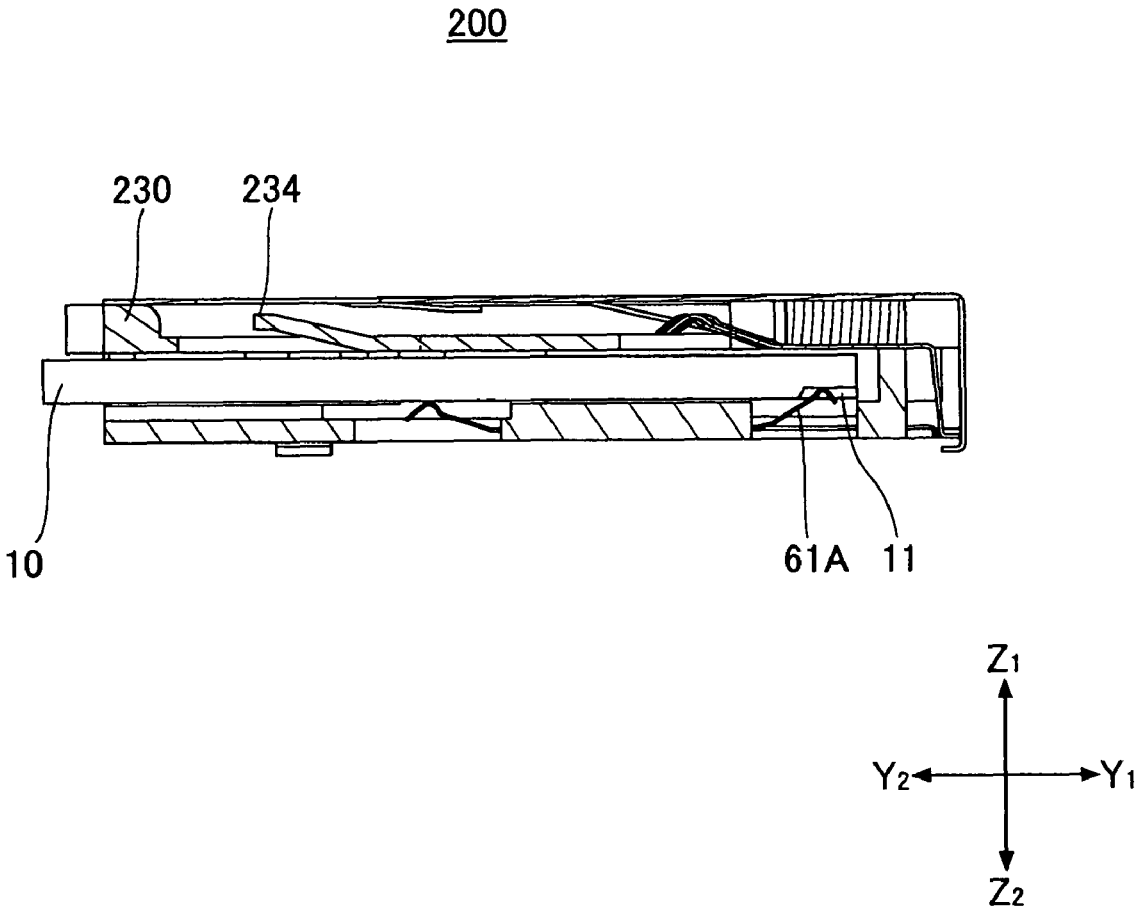
FIG. 26 is a diagram showing the first card connected to the card connector according to the second embodiment.

As is shown in FIG. 26, the first card 10 may be connected to the card connector 200 by inserting the first card 10 into the card loading slot 201 and pushing the rear end of the inserted first card 10 with fingers so that the first card 10 reaches its final position from which it may not be inserted further. In this way, the first card 10 may be accommodated inside the card accommodating space 202 and the contact 11 of the first card 10 may come into contact with the first card contact member 61A of the card connector 200.

It is noted that the connected first card 10 may be ejected by pushing the rear end of the connected first card 10 slightly inward with fingers and then letting go so that the push-push type ejecting mechanism may be operated and the first card 10 may be slightly pushed out. In turn, the user may hold the rear end of the first card 10 with his/her fingers to pull out the first card 10.

[Connection of Second Card 20]

Figure 27:
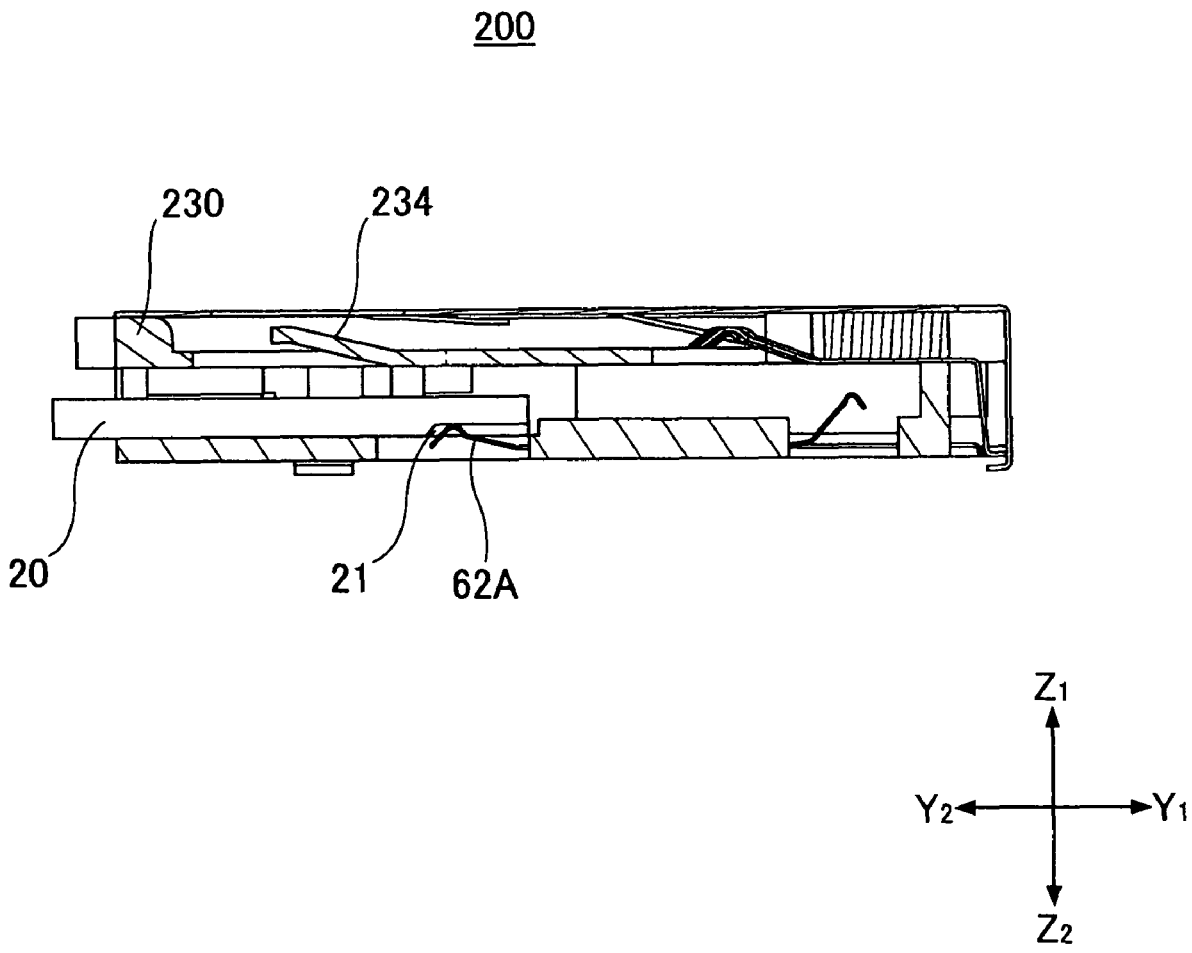
FIG. 27 is a diagram showing the second card connected to the card connector according to the second embodiment.

As is shown in FIG. 27, the second card 20 may be connected to the card connector 200 by inserting the second card 20 into the card loading slot 201 and pushing the rear end of the inserted second card 20 with fingers so that the second card 10 reaches its final position from which it may not be inserted further. In this way, the second card 20 may be accommodated inside the card accommodating space 202 and the contact 21 of the second card 20 may come into contact with the second card contact member 62A of the card connector 200.

It is noted that the connected second card 20 may be ejected from the card connector 200 in a manner similar to the manner in which the first card 10 is ejected from the card connector 200 as is described above.

[Connection of Third Card 30]

Upon connecting the third card 30 to the card connector 200, a user may use his/her fingers to push and then release the protruding portion 235 so that the push-push ejecting mechanism may be operated and the third card tray 230 may be thrust outward as is shown in FIG. 24. Then, the user may place the third card 30 in the third card tray 230 and push the third card tray 230 in the inserting direction (Y1 direction) so that the third card 30 may be pushed toward the Z2 direction by the plate springs 241 and 242 and the contact 31 may come into contact with the third card contact member 63A of the card connector 200.

Upon ejecting the connected third card 30, the user may use his/her fingers to push and then release the protruding portion 235 so that the push-push type ejecting mechanism may be operated and the third card tray 230 may be thrust outward with the third card 30. In this case, the third card 30 is slightly pushed upward by the extended piece 234. In turn, the user may pick up the third card 30 from the third card tray 230.

[Restricting Card Connection]

Figure 29:
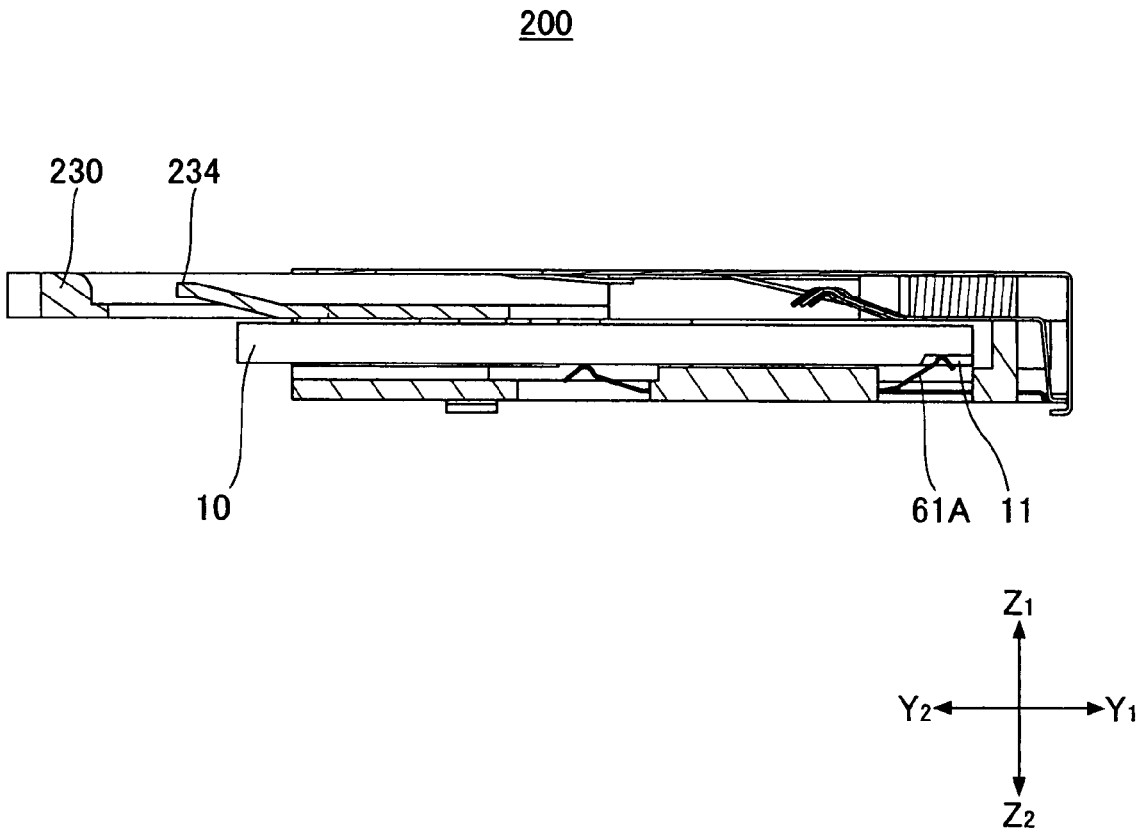
FIG. 29 is a diagram the first card connected to the card connector according to the second embodiment with the third card tray thrust out.

As is shown in FIG. 29, even when the first or second card 10/20 is connected to the card connector 200, the third card tray 230 may still be thrust out by pushing and releasing the protruding portion 235 as is described above. However, since the extended piece 234 is in contact with the upper face of the connected first or second card 10/20 and is thereby prevented from being displaced in the Z2 direction, the third card 30 cannot be connected in this case.

Figure 28:
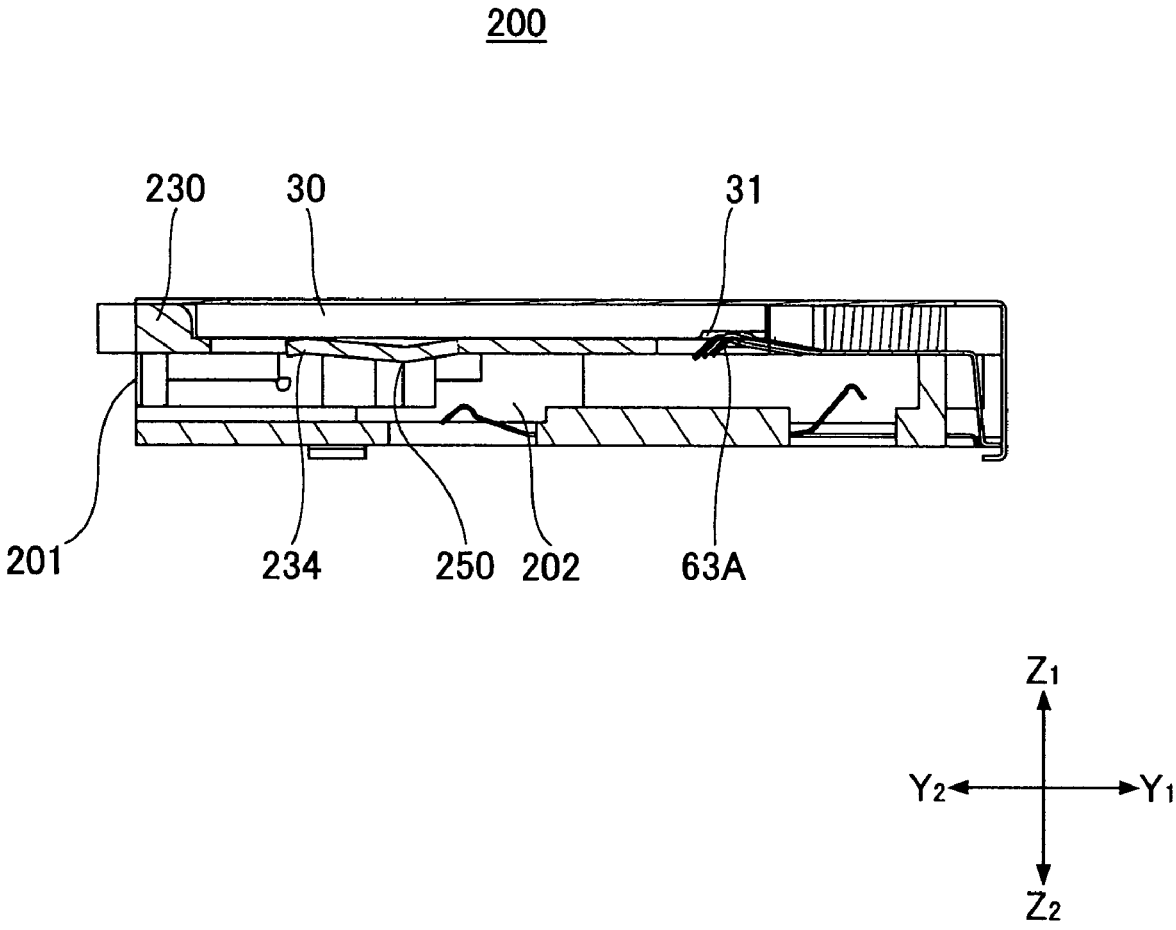
FIG. 28 is a diagram showing the third card connected to the card connector according to the second embodiment.

As is shown in FIG. 28, when the third card 30 is connected to the card connector 200, a portion 250 of the extended piece 234 is thrust toward the lower side of the third card tray 230 into the card accommodating space 202 at a location near the card loadings lot 201. The thrust portion 250 blocks the first or second card 10/20 from being inserted so that connection of the first or second card 10/20 may be restrained.

In one embodiment, operations of the push-push type ejecting mechanism for the first and second cards 10, and the push-push type ejecting mechanism for the third card tray 230 may be controlled in relation to each other such that one of the ejecting mechanisms is prevented from operating when the other is operating, for example. In this way, the third card 30 may be prevented from being connected when the first or second card 10/20 is connected, and the first or second card 10/20 may be prevented from being connected when the third card 30 is connected.

It is noted that the specific types of cards representing the first through third cards 10-30 are not limited to the memory stick (trademark), the SD card (trademark), and the memory stick Duo (trademark) as in the above-described embodiments and other embodiments adapted for other types of cards may equally be conceived. For example, the second card 20 may correspond to the MMCplus (multimedia card plus) (trademark) instead of the SD card (trademark).

Further, the present invention is not limited to the above-described embodiments, and variations and modifications may be made without departing from the scope of the present invention.

The present application is based on and claims the benefit of the earlier filing date of Japanese Patent Application No. 2007-050480 filed on Feb. 28, 2007, the entire contents of which are hereby incorporated by reference.

What is claimed is:

1. A card connector comprising:

a housing for accommodating a first card, a second card, and a third card;

a first contact member arranged inside the housing to be connected to the first card;

a second contact member arranged inside the housing to be connected to the second card, which has a larger width than the first card and a smaller thickness than the first card;

a third contact member arranged inside the housing to be connected to the third card, which has a smaller width than the first card and the second card and a smaller thickness than the first card and the second card; and a control mechanism configured to selectively guide each one of the first card, the second card, and the third card to a corresponding one of a first contact position, a second contact position and a third contact position in order to connect to the first contact member, the second contact member, and the third contact member, respectively, a bottom face of the first card situated at the first contact position, a bottom face of the second card situated at the second contact position, and a bottom face of the third card situated at the third contact position being non-coplanar;

wherein when one of the first card, the second card, and the third card is connected, the control mechanism prevents other cards from being connected;

wherein the control mechanism includes a common card loading slot to which one of the first card and the second card is to be inserted, the common card loading slot being closed by the inserted one of the first card and the second card;

a third card tray that is displaceably arranged at an upper side of a card accommodating space connected to the common card loading slot, the third card tray being configured to connect the third card to the third contact member when the third card is placed in the third card tray and the third card tray is inserted toward the third contact member; and a regulating mechanism that prevents the first card and the second card from being inserted into the card accommodating space via the common card loading slot when the third card is placed in the third card tray and the third card tray is inserted toward the third contact member, wherein the regulating mechanism includes a thrust portion that is thrust toward the card accommodating space with respect to the third card tray when the third card is placed in the third card tray, wherein the regulating mechanism includes a thrust portion that is thrust toward the card accommodating space with respect to the third card tray when the third card is placed in the third card tray.

2. The card connector as claimed in claim 1, wherein the control mechanism includes a common card loading slot into which any one of the first card, the second card, and the third card is to be inserted, the common card loading slot being closed by the inserted one of the first card, the second card, and the third card;

a third card regulating mechanism that is arranged within a card accommodating space connected to the common card loading slot which third card regulating mechanism regulates a connection position of the third card when the third card is inserted into the common card loading slot.

3. The card connector of claim 1, wherein at least one of the first contact member, the second contact member and the third contact member is located on an opposite side of the housing than a side on which another one of the first contact member, the second contact member and the third contact member is located.

4. The card connector of claim 1, wherein the third contact member is located on an opposite side of the housing than a side which the first contact member and the second contact member are located.

5. A card connector, comprising:

a housing for accommodating a first card, a second card, and a third card;

a first contact member arranged inside the housing to be connected to the first card;

a second contact member arranged inside the housing to be connected to the second card, which has a larger width than the first card and a smaller thickness than the first card;

a third contact member arranged inside the housing to be connected to the third card, which has a smaller width than the first card and the second card and a smaller thickness than the first card and the second card; and a connection control mechanism configured to selectively connect one of the first card, the second card, and the third card;

wherein when one of the first card, the second card, and the third card is connected, the connection control mechanism prevents the other cards from being connected wherein the control mechanism includes a common card loading slot into which any one of the first card, the second card, and the third card is to be inserted, the common card loading slot being closed by the inserted one of the first card, the second card, and the third card, and a third card regulating mechanism that is arranged within a card accommodating space connected to the common card loading slot which third card regulating mechanism regulates a connection position of the third card when the third card is inserted into the common card loading slot, and wherein the third card regulating mechanism includes a door member having an upper side that is rotatably arranged within the card accommodating space and a lower side that forms a third card loading slot for inserting the third card when the door member is in a closed position, the door member being pushed and rotated to an open position by one of the first card and the second card when said one of the first card and the second card is inserted into the common card loading slot;

a third card regulating member that has one side connected to the door member and is arranged at a rear side of the door member, the third card regulating member being configured to move along an arc-shaped path to be displaced in conjunction with the rotation of the door member when the door member is rotated to the open position and regulate an upper face of the third card that is inserted into the third card loading slot when the door member is in the closed position; and a locking member that locks the door member in a vertical position corresponding to the closed position, the locking member being configured to maintain the lock of the door member when the third card is inserted and release the lock of the door member when one of the first card and the second card is inserted.

6. The card connector as claimed in claim 5, wherein the third card regulating member includes a movement regulating mechanism that regulates movement of an opposite side of the one side of the third card regulating member connected to the door member and prevents said opposite side from being displaced away from the upper face of the inserted third card when the door member is in the closed position.

7. The card connector as claimed in claim 5, further comprising:

a metal plate cover member that covers an upper side of the housing; wherein the third card regulating member includes a plate spring portion that is created by cutting and bending the metal plate cover member and is configured to apply a spring force to the displaced third card regulating member towards an original position of the third card regulating member in a direction for closing the door member.

8. The card connector as claimed in claim 5, wherein the locking member includes a metal plate member having a part that engages a part of the door member; and the metal plate member includes a card guide part configured to guide one of the first card and the second card that is inserted into the common card loading slot.

9. A card connector, comprising:

a housing in which cards having one of a first card type, a second card type, and a third card type are alternatively inserted, each card type having at least one of a length, a width and a thickness different from any other card type;

a first contact member arranged inside the housing to be connected to a card having the first type;

a second contact member arranged inside the housing to be connected to a card having the second card type;

a third contact member arranged inside the housing to be connected to a card having the third card type; and a control mechanism configured to selectively guide a card inserting in the housing to a corresponding one of a first contact position, a second contact position and a third contact position depending whether an inserted card type is the first card type, the second card type or the third card type, in order to connect the card to the first contact member, the second contact member, and the third contact member, respectively, wherein if the card is connected, the control mechanism prevents other cards from being connected, a bottom face of a card having the first type inserted at the first contact position, a bottom face of a card having the second type inserted at the second contact position, and a bottom face of a card having the third type inserted at the third contact position being non-coplanar;

wherein the control mechanism includes a common card loading slot to allow inserting a card having one of the first card type and the second card type, the common card loading slot being closed by the inserted card having one of the first card type and the second card type;

a third card tray that is arranged at an upper side of a card accommodating space connected to the common card loading slot, the third card tray being configured to connect a card having the third card type to the third contact member when the card is placed in the third card tray and the third card tray is inserted toward the third contact member; and a regulating mechanism that prevents a card having one of the first card type and the second card type from being inserted into the card accommodating space via the common card loading slot when a card having the third card type is placed in the third card tray and the third card tray is inserted toward the third contact member, wherein the regulating mechanism includes a thrust portion that is thrust toward the card accommodating space with respect to the third card tray when a card having the third card type is placed in the third card tray.

10. The card connector as claimed in claim 9, wherein the control mechanism includes a common card loading slot through which a card having any one of the first card type, the second card type, and the third card type is inserted in the housing, the common card loading slot being closed when a card is inserted;

a third card regulating mechanism that is arranged within a card accommodating space connected to the common card loading slot, to regulate a connection position of a card having the third card type inserted into the common card loading slot, the third card type having smaller width, length and thickness than the first and second card types.

11. The card connector of claim 9, wherein at least one of the first contact member, the second contact member and the third contact member is located on an opposite side of the housing than a side on which another one of the first contact member, the second contact member and the third contact member is located.

12. A card connector, comprising:

a housing in which cards having one of a first card type, a second card type, and a third card type are alternatively inserted, each card type having at least one of a length, a width and a thickness different from any other card type;

a first contact member arranged inside the housing to be connected to a card having the first type;

a second contact member arranged inside the housing to be connected to a card having the second card type;

a third contact member arranged inside the housing to be connected to a card having the third card type; and a control mechanism configured to selectively guide a card inserting in the housing to a corresponding one of a first contact position, a second contact position and a third contact position depending whether an inserted card type is the first card type, the second card type or the third card type, in order to connect the card to the first contact member, the second contact member, and the third contact member, respectively, wherein if the card is connected, the control mechanism prevents other cards from being connected, and wherein the first contact member, the second contact member and the third contact member are located at different positions in a plane perpendicular to a card insertion direction, wherein the control mechanism includes a common card loading slot through which a card having any one of the first card type, the second card type, and the third card type is inserted in the housing, the common card loading slot being closed when a card is inserted;

a third card regulating mechanism that is arranged within a card accommodating space connected to the common card loading slot, to regulate a connection position of a card having the third card type inserted into the common card loading slot, the third card type having smaller width, length and thickness than the first and second card types, and wherein the third card regulating mechanism includes a door member having an upper side that is rotatably arranged within the card accommodating space and a lower side that forms a third card loading slot for inserting a card having the third card type when the door member is in a closed position, the door member being pushed and rotated to an open position by a card having the first card type or the second card type inserted into the common card loading slot, wherein a third card regulating member that has one side connected to the door member and is arranged at a rear side of the door member, the third card regulating member being configured to move along an arc-shaped path to be displaced in conjunction with the rotation of the door member when the door member is rotated to the open position and regulate an upper face of a card having the third card type inserted into the third card loading slot when the door member is in the closed position; and a locking member that locks the door member in a vertical position corresponding to the closed position, the locking member being configured to maintain the lock of the door member when a card having the third card type is inserted, and to release the lock of the door member when a card having of the first card type and the second card type is inserted.

13. The card connector as claimed in claim 12, wherein the third card regulating member includes a movement regulating mechanism that regulates movement of an opposite side of the one side of the third card regulating member connected to the door member and prevents said opposite side from being displaced away from the upper face of the inserted card of the third card type when the door member is in the closed position.

14. The card connector as claimed in claim 12, further comprising:

a metal plate cover member that covers an upper side of the housing, wherein the third card regulating member includes a plate spring portion that is created by cutting and bending the metal plate cover member, and is configured to apply a spring force to the displaced third card regulating member towards an original position of the third card regulating member in a direction for closing the door member.

15. The card connector as claimed in claim 12, wherein the locking member includes a metal plate member having a part that engages a part of the door member, and a card guide part configured to guide a card having one of the first card type and the second card type that is inserted into the common card loading slot.

* * * * *